US011959161B2

(12) United States Patent
Kise et al.

(10) Patent No.: US 11,959,161 B2
(45) Date of Patent: Apr. 16, 2024

(54) COPPER-BASED ALLOY MATERIAL, PRODUCTION METHOD THEREFOR, AND MEMBERS OR PARTS MADE OF COPPER-BASED ALLOY MATERIAL

(71) Applicants: FURUKAWA TECHNO MATERIAL CO., LTD., Hiratsuka (JP); TOHOKU UNIVERSITY, Sendai (JP); FURUKAWA ELECTRIC CO., LTD., Tokyo (JP)

(72) Inventors: Sumio Kise, Hiratsuka (JP); Fumiyoshi Yamashita, Hiratsuka (JP); Misato Fujii, Hiratsuka (JP); Koji Ishikawa, Hiratsuka (JP); Ryosuke Kainuma, Sendai (JP); Toshihiro Omori, Sendai (JP); Nobuyasu Matsumoto, Sendai (JP)

(73) Assignees: FURUKAWA TECHNO MATERIAL CO., LTD., Hiratsuka (JP); TOHOKU UNIVERSITY, Sendai (JP); FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/272,852

(22) PCT Filed: Aug. 30, 2019

(86) PCT No.: PCT/JP2019/034181
§ 371 (c)(1),
(2) Date: Mar. 2, 2021

(87) PCT Pub. No.: WO2020/050175
PCT Pub. Date: Mar. 12, 2020

(65) Prior Publication Data

US 2021/0317557 A1 Oct. 14, 2021

(30) Foreign Application Priority Data

Sep. 3, 2018 (JP) ..... 2018-164272

(51) Int. Cl.
*C22F 1/08* (2006.01)
*C22C 1/02* (2006.01)
(Continued)

(52) U.S. Cl.
CPC ..... *C22F 1/08* (2013.01); *C22C 1/02* (2013.01); *C22C 9/01* (2013.01); *C22C 9/05* (2013.01); *C22C 9/06* (2013.01)

(58) Field of Classification Search
CPC ..... C22F 1/08; C22F 1/00; C22C 1/02; C22C 9/01; C22C 9/05; C22C 9/06
See application file for complete search history.

(56) References Cited

U.S. PATENT DOCUMENTS 4,551,975 A 11/1985 Yamamoto et al.
4,634,477 A * 1/1987 Sugimoto ..... C22C 9/01 148/402

(Continued)

FOREIGN PATENT DOCUMENTS

CN 1230230 A 9/1999
CN 1644728 A 7/2005

(Continued)

OTHER PUBLICATIONS

J. L. L. Gama, C. C. Dantas, N. F. Quadros, R. A. S. Ferreira, Y. P. Yadava, Microstructure-Mechanical Property Relationship to Copper Alloys with Shape Memory during Thermomechanical Treatments, Jan. 2006, Metallurgical and Materials Transactions, vol. 37A, pp. 77-87 (Year: 2006).*

(Continued)

*Primary Examiner* — Anthony M Liang
*Assistant Examiner* — Maxwell Xavier Duffy
(74) *Attorney, Agent, or Firm* — Oblon, McClelland, Maier & Neustadt, L.L.P.

(57) ABSTRACT

A copper-based alloy material including a multiphase structure containing a matrix of a β phase and a precipitation phase of a B2-type crystal structure dispersed in the matrix, where the copper-based alloy material includes a composition containing 8.6 to 12.6% by mass of Al, 2.9 to 8.9% by mass of Mn, 3.2 to 10.0% by mass of Ni, and Cu.

28 Claims, 6 Drawing Sheets

(51) Int. Cl.

| | |
|---|---|
| ***C22C 9/01*** | (2006.01) |
| ***C22C 9/05*** | (2006.01) |
| ***C22C 9/06*** | (2006.01) |

(56) References Cited

U.S. PATENT DOCUMENTS

| | | | | |
|---|---|---|---|---|
| 6,406,566 | B1 | 6/2002 | Ishida et al. | |
| 2013/0087074 | A1 | 4/2013 | Araki et al. | |
| 2015/0354046 | A1 | 12/2015 | Tuncer et al. | |
| 2016/0376688 | A1* | 12/2016 | Fujii | B22D 21/005 420/471 |

FOREIGN PATENT DOCUMENTS

| | | | | |
|---|---|---|---|---|
| EP | 0 947 592 | A1 | | 10/1999 |
| EP | 1 069 200 | A1 | | 1/2001 |
| JP | 60-177159 | A | | 9/1985 |
| JP | 5-311287 | A | | 11/1993 |
| JP | 2001-20026 | A | | 1/2001 |
| JP | 2001-131658 | A | | 5/2001 |
| JP | 3300684 | B2 | | 7/2002 |
| JP | 3335224 | B2 | | 10/2002 |
| JP | 2005298952 | A | * | 10/2005 |
| JP | 3872323 | B2 | | 1/2007 |
| JP | 5837487 | B2 | | 12/2015 |
| JP | 6109329 | B2 | | 4/2017 |
| JP | 2017-518439 | A | | 7/2017 |
| JP | 2017-141491 | A | | 8/2017 |
| WO | WO99/49092 | A1 | | 9/1999 |
| WO | WO 2011/152009 | A1 | | 12/2011 |
| WO | WO 2015/137283 | A1 | | 9/2015 |
| WO | WO 2016/003540 | A2 | | 1/2016 |
| WO | WO 2016/003540 | A3 | | 1/2016 |

OTHER PUBLICATIONS

Extended European Search Report dated May 23, 2022, in corresponding European Patent Application No. 19857193.7, 12 pages.

Combined Chinese Office Action and Search Report dated Aug. 23, 2021 in corresponding Chinese Patent Application No. 201980057440.1 (with English Translation and English Translation of Category of Cited Documents). 14 pages.

He Mingke et al., "Study on the high temperature residual embossing of Cu—Al—Ni—Mn shape memory alloy", Journal of Hebei Institute of Mechanical and Electrical Engineering, vol. 10, issue 1, vol. 10, No. 1. 1993,17 pages (with English Abstract and English Translation).

International Search Report dated Nov. 26, 2019 in PCT/JP2019/034181 filed on Aug. 30, 2019, 2 pages.

Notice of Reasons for Refusal dated Feb. 2, 2021 in Japanese Patent Application No. 2018-164272, 7 pages (with English translation).

Sutou, Y. et al., "Development of Cu—Al—Mn-based Shape Memory Alloys with Enhanced Ductility," Materia Japan, vol. 42, Issue 11, 2003, pp. 813-821, 21 total pages (with English translation).

Shrestha, K. C. et al., "Functional Fatigue of Polycrystalline Cu—Al—Mn Superelastic Alloy Bars under Cyclic Tension," Journal of Materials in Civil Engineering, vol. 28, 04015194, 2015, pp. 1-10.

Ozu, T. et al., "319 Cyclic Superelastic Behavior of CuAlMn Shape-Memory Alloy Single Crystal," The Society of Materials Science, ol. 45, 1996, pp. 169-170, 5 total pages (with English translation).

Goryczka, T., "Effect of Wheel Velocity on Texture Formation and Shape Memory in Cu—Al—Ni Based Melt-Spun Ribbons," Archives of Metallurgy and Materials, vol. 54, Issue 3, 2009, pp. 755-763.

Korean Office Action dated Aug. 31, 2022 in Korean Patent Application No. 10-2021-7008793 (with unedited computer generated English translation), 17 pages.

* cited by examiner

COPPER-BASED ALLOY MATERIAL, PRODUCTION METHOD THEREFOR, AND MEMBERS OR PARTS MADE OF COPPER-BASED ALLOY MATERIAL

TECHNICAL FIELD

The present invention relates to a copper-based alloy material which is excellent in fatigue resistance and fracture resistance even when the copper-based alloy material is deformed by repeating predetermined loading, in particular, loading of a stress applying a shape-memory alloy-specific strain and unloading thereof, a production method therefor and members or parts made of the copper-based alloy material.

BACKGROUND ART

A shape-memory alloy refers to a metal material which can be returned to the shape before deformation by a temperature change or unloading of a stress that is loaded. The characteristics of the shape-memory alloy can be classified into two characteristics one of which is that a deformed material is heated to be restored to the shape before the deformation (this characteristic is called a "shape memory effect") and the other of which is that even when the shape-memory alloy is deformed by loading of a stress applying a strain exceeding the maximum elastic strain, the shape-memory alloy is returned to the shape before the deformation by unloading of the stress (this characteristic is called "superelasticity").

Once a normal metal material is plastically deformed by application of a stress exceeding an elastic limit, the metal material is not returned to the shape before the deformation unless working is performed thereon again whereas the shape-memory alloy has a unique property so as to be able to develop the characteristics as described above. In the present invention, the "shape-memory alloy" is defined as an alloy which shows at least the superelasticity of the characteristics described above, such as the shape memory effect and the superelasticity.

Since the shape-memory alloy shows the remarkable shape memory effect and superelasticity accompanied with the reverse transformation of thermoelastic martensitic transformation resulting excellent functions around a living environment temperature, the shape-memory alloy is practically used in various fields.

As a typical material of the shape-memory alloy, for example, a Ti—Ni alloy and a copper-based alloy are mentioned. Although the copper-based shape-memory alloy (hereinafter also simply referred to as the "copper-based alloy") is generally inferior in a repeat characteristic, corrosion resistance and the like to the Ti—Ni alloy, since the copper-based shape-memory alloy is inexpensive, its application range tends to be extended.

However, although the conventional copper-based alloy material is advantageous in terms of cost, cold workability is poor, and thus the conventional copper-based alloy material does not reach the desired target levels of the shape memory effect and the superelasticity. Hence, although various studies have been conducted, the copper-based alloy serving as the shape-memory alloy is not always sufficiently put to practical use.

Incidentally, regardless of an alloy composition, even when the shape-memory alloy is subjected to deformation caused by loading and unloading of a stress or a temperature change, the crystal structure thereof is transformed from a parent phase which is a low-temperature phase into a martensite phase which is a high-temperature phase, with the result that the shape-memory alloy can be returned to its original shape even if the shape-memory alloy is significantly deformed in appearance.

Shape-memory alloys formed from various alloy compositions have so far been developed, and one of development policies is that crystal structures are ordered structures (for example, a B19-type, a $DO_{19}$-type, a B2-type and an $L2_1$-type). Among them, it is known that as the consistency of the crystal structure is increased, resistance to deformation is increased, and from this point of view, it can be considered that an alloy composition, such as a full-Heusler alloy ($L2_1$-type), which has a crystal structure of a high degree of order is preferable. However, in general, there is a tendency that as the degree of order is increased, workability is degraded, and from this point of view, a Heusler alloy having a high degree of order is disadvantageous in that it is difficult to perform working.

Since it is difficult to produce the alloy having the crystal structure of a high degree of order as described above by a normally performed working method such as cold working or hot working, for example, a special production method such as a quenching solidification method (for example, Patent Document 1), a Czochralski method or a Bridgeman method (for example, Non-Patent Document 2) is needed. However, when the special production method described above is adopted, shapes which can be produced are restricted, with the result that there is a disadvantage in that the flexibility of the shapes which can be produced is lowered. For the same reason, an alloy having an ordered structure is inferior in workability, and thus such an alloy is often prevented from being put to practical use.

On the other hand, a Cu—Al—Mn alloy is a copper-based alloy in which the disadvantageous workability described above is improved by bringing the Cu—Al—Mn alloy into a two-phase state of an $L2_1$-type ordered phase β which is a B phase and has a body-centered cubic (bcc) structure) and an Al-type phase (which is an α phase and has a face-centered cubic (fcc) structure at the time of working. Furthermore, thereafter, a single-phase structure of the β phase is formed by quenching from a high temperature, and thus it is possible to achieve a crystal structure having only the $L2_1$-type ordered phase. The β phase of the Cu—Al—Mn alloy has a different crystal structure depending on the alloy composition thereof, and the β phase has a crystal structure of any one of an A2-type disordered phase, a B2-type ordered phase and the $L2_1$-type ordered phase.

Non-Patent Document 1 discloses a highly workable Cu—Al—Mn-based shape memory alloy, and FIG. 1(*b*) therein shows, in Cu—Al-10 at % Mn, a decrease in the concentration of Al and rapid decreases in the ordering temperatures of $Tc^{A2-B2}$ and $Tc^{B2-L21}$. Hence, it is expected that 10 at % of Mn is added to extend a β single-phase region to the low concentration side of Al, and that workability can be improved by lowering the degree of order of the β phase.

However, when the degree of order of the alloy is lowered, the workability is improved whereas since the degree of order is an important factor for guaranteeing shape memory characteristics, the lowering of the degree of order of the alloy disadvantageously causes the deterioration of the shape memory characteristics.

As described above, the Cu—Al—Mn-based shape memory alloy constantly has a trade-off relationship between workability and a shape recovery rate (shape memory effect). With respect to the above-described disadvantage in the Cu—Al—Mn alloy, FIG. 2 in Non-Patent Document 1 shows that a cold working rate does not depend on the concentration of Mn within a range of 9 to 13 at % of Mn but depends on the concentration of Al.

In an A2-type disordered region where Al is equal to or less than 16 at %, the shape recovery rate is found to be lowered whereas in a region where Al exceeds 16 at %, the shape recovery rate is found to be so high as to be equal to or greater than 90%. Hence, it has begun to be found that when the Cu—Al—Mn-based shape-memory alloy is made to fall within a specific composition range, it is possible to achieve both the workability and the shape memory characteristics, with the result that various studies have been conducted in order to apply the Cu—Al—Mn alloy to the shape-memory alloy.

For example, a Heusler-type shape memory alloy having a high degree of order is disclosed in Patent Document 1, and a Cu—Al—Mn-based alloy of a β single-phase structure having excellent cold workability is disclosed in Patent Documents 2 to 6 and Non-Patent Documents 1 and 2.

Patent Document 1: Japanese Patent No. 3872323

Patent Document 2: Japanese Patent No. 3335224

Patent Document 3: Japanese Patent No. 3300684

Patent Document 4: Japanese Patent No. 5837487

Patent Document 5: Japanese Patent No. 6109329

Patent Document 6: Japanese Unexamined Patent Application, Publication No. 2017-141491

Non-Patent Document 1: Yuji Sudo and four others, "Development of Highly Workable Cu—Al—Mn-based Shape Memory Alloy", Materia, the Japan Institute of Metals and Materials, 2003, Vol. 42, No. 11, p. 813-821

Non-Patent Document 2: Kshitij C Shrestha and four others, "Functional Fatigue of Polycrystalline Cu—Al—Mn Superelastic Alloy Bars under Cyclic Tension", Journal of Materials in Civil Engineering, American Society of Civil Engineers, 2015, Volume 28, p. 04015194

Non-Patent Document 3: Toshihisa Ozu and three others, "Superelastic Repeated Behavior of Cu—Al—Mn Shape Memory Alloy Single Crystal", Proceedings of Academic Lectures, Society of Materials Science, Japan, 1996, Vol. 45, p. 169-170

DISCLOSURE OF THE INVENTION

Problems to be Solved by the Invention

Patent Document 1 discloses a Co—Ni—Ga-based Heusler-type magnetic shape memory alloy, that is, a Heusler-type (composition ratio of $A_2BC$) magnetic shape memory alloy. However, for the shape-memory alloy disclosed in Patent Document 1, the special production method called the quenching solidification method is adopted. Patent Document 1 discloses neither a copper-based alloy nor the improvement of workability which is the problem of a copper-based alloy having an ordered structure to be solved.

Since the Cu—Al—Mn-based alloy disclosed in Patent Document 2 is formed to have a β single phase at the time of working and is thereafter subjected to ordering treatment, cold workability is excellent but in particular superelasticity is not sufficient. It can be considered that the reason for this is that due to, for example, a random crystalline orientation, a strong binding force is generated between crystal grains at the time of deformation so as to introduce an irreversible defect such as a dislocation. Hence, it can be considered that it is impossible to obtain satisfactory superelasticity, that the amount of residual strain accumulated by repeated deformation tends to be increased and that the deterioration of superelasticity easily occurs after the repeated deformation. It is expected that sufficient fatigue resistance cannot be obtained when the repeated deformation is performed, and that the amount of residual strain accumulated is increased. In the material of the invention shown in table 1 of Patent Document 2, a shape recovery rate is a high value so as to be equal to or greater than 95% but the shape recovery rate described above has only the value obtained by loading a stress applying a small strain whose deformation strain amount is 2%, and the shape recovery rate is not sufficient for parts or members to which the shape-memory alloy is applied, with the result that there is room for improvement.

Patent Document 3 discloses a copper-based alloy in which a crystalline orientation to a B single phase is controlled in order to enhance the shape memory effect and the superelasticity of the copper-based alloy, in which the average crystal grain diameter is set equal to or greater than half the diameter of a wire for a wire material or set equal to or greater than the thickness of a plate for a plate material, in which a region having such a crystal grain diameter is set equal to or greater than 30% of the total length of the wire material or the total area of the plate material and in which thus while excellent workability is being maintained, high shape memory characteristics and superelasticity are achieved. However, in the method disclosed in Patent Document 3, the control of the grain diameter distribution of crystal grains having a predetermined large crystal grain diameter is not sufficient in the Cu—Al—Mn-based alloy, and variations in the performance of the developed shape memory effect and superelasticity are produced, with the result that there is room for improvement in that these characteristics are not stable. It is likely that a residual strain accumulated by repeated deformation is increased, and that thus the deterioration of the shape memory effect and the superelasticity after the repeated deformation occurs.

Patent Document 4 discloses the Cu—Al—Mn-based alloy in which the maximum crystal grain diameter exceeding 8 mm is set to be able to realize a structural material having satisfactory shape memory characteristics and a relatively large cross-sectional size applicable to a structure or the like. However, disadvantageously, in the method disclosed in Patent Document 4, the control of the grain diameter distribution of crystal grains having a predetermined large crystal grain diameter is not sufficient in the Cu—Al—Mn-based alloy, and the degree of accumulation of a structure is low, with the result that the shape memory effect and the superelasticity are not stable. Although a residual strain accumulated by repeated deformation is not disclosed, it is expected that the amount of residual strain accumulated is increased to cause the remarkable deterioration of the shape memory effect and the superelasticity after the repeated deformation. Furthermore, disadvantageously, in the Cu—Al—Mn-based alloy disclosed in Patent Document 4, since the maximum value of the maximum crystal grain diameter is about 150 mm, for example, when the Cu—Al—Mn-based alloy is applied to parts or members of a large shape-memory alloy such as a building material having a total length of 300 mm or more, both fatigue resistance and fracture resistance when the part or the member is deformed by repeating, in particular, loading of a stress applying a shape-memory alloy-specific strain and unloading thereof are not stably obtained at high levels.

The present inventors propose, in Patent Document 5, the Cu—Al—Mn-based alloy material which has a recrystallized structure substantially formed from a β single phase, in which crystal grains existing in the recrystallized structure are defined as two types of crystal grains that are large crystal grains and small crystal grains, in which control is further performed such that the existing amount of large crystal grains occupied in the entire alloy material is increased and that the existing amount of small crystal grains is decreased and in which thus repeated deformation resistance is excellent. The present inventors further propose, in Patent Document 6, the Cu—Al—Mn-based alloy material in which, for crystal grains where the length of the crystal grains in a direction perpendicular to the direction of working of the alloy material is equal to the width or the diameter R of the alloy material and where a=R, the existing amount of the number X of grain boundaries and the number of times a fracture occurs when loading and unloading of a stress applying a 3% strain is repeated are specified, and in which thus fracture resistance when the repeated deformation is performed is so high as to be excellent.

Although with respect to the evaluation of the repeated deformation resistance on the Cu—Al—Mn-based alloy material disclosed in Patent Document 5, the repeated deformation resistance is regarded as being excellent when the residual strain after a cycle of loading and unloading of a 5% strain is repeated 100 times is equal to or less than 2.0%, since the number of cycles is so small as to be 100 and it is assumed that in particular when the alloy material is used as a vibration damping (seismic vibration damping) material or a building material in the future, the acceptance level of the repeated deformation resistance is further increased, it is required to develop a Cu—Al—Mn-based alloy material in which even when the number of cycles is increased to exceed 100 (for example, 1000) and thus the test is performed under more stringent test conditions, the excellent repeated deformation resistance can be maintained without being deteriorated.

Likewise, in Patent Document 6, with respect to the evaluation of the repeated deformation resistance, the number of cycles in which loading and unloading of a 5% strain is repeated is so small as to be 100 or the amount of strain loaded is so small as to be 3% though the number of cycles is so large as to be 1000, and thus as in Patent Document 5, it is required to develop a Cu—Al—Mn-based alloy material in which even when the test is performed under more stringent test conditions, the excellent repeated deformation resistance can be maintained without being deteriorated.

Non-Patent Document 1 discloses that in the Cu—Al—Mn-based shape memory alloy, structure control is performed so as to obtain an excellent shape memory effect and excellent superelasticity. Non-Patent Document 1 also discloses followings. Specifically, (I) the β single-phase region is greatly extended to, in particular, the low concentration side of Al by addition of Mn;

(II) in a Cu—Al binary system, the β single-phase region existing in only a high-temperature region is stable even in a low-temperature region of 400° C. or less, and a sequential ordered-disordered transformation appears from a high temperature to a disordered A2, to an ordered B2 and to an ordered $L2_1$ Heusler phase;

(III) A2/B2 and B2/$L2_1$ ordering temperatures are sensitive to the concentration of Al, and thus the concentration of Al is equal to or less than 18 at % and the temperatures drop below 500° C.;

(IV) it is expected that the drop in the ordering transformation temperatures as described above inevitably involves a drop in the degree of order of an $L2_1$ phase, and an A2 disordered phase is actually formed by quenching on the low side of Al with respect to about 16 at % of Al; and (V) on the high side of Al, $L2_1$ ordering can be achieved by water quenching.

Then, Non-Patent Document 1 discloses that at the time of working, control is performed to have a two-phase structure of an α phase and a β phase (a fcc structure and a bcc structure) so as to be able to perform working, that an $L2_1$-type ordered structure can be finally formed by the ingenious method as described above and that thus the Cu—Al—Mn-based shape memory alloy capable of achieving both cold workability and a shape memory effect and superelasticity is provided. Non-Patent Document 1 also discloses that when a ratio d/D between a crystal grain diameter d and a wire diameter D is 4.72 so as to be greater than 1, a shape recovery rate equal to or greater than 7% is obtained. The shape memory rate here is obtained by performing, at a liquid nitrogen temperature, bending deformation having a surface strain of 2% on a plate material having a thickness of 0.2 mm and heating it to 200° C. However, it is disclosed that the Cu—Al—Mn alloy having a shape recovery rate equal to or greater than 7% shows a complete bamboo structure, when a deformation test which repeats loading and unloading of a stress applying a high strain (for example, a 5% strain) is performed on the Cu—Al—Mn alloy having the bamboo structure, the strain is easily left after a high number of cycles (for example, the number of cycles is equal to or greater than 1000) and thus it is likely that sufficient fatigue resistance cannot be obtained, with the result that there is room for improvement.

Non-Patent Document 2 discloses the results of a repeated tensile load cycle test applying a 6 to 7% strain which is performed on the Cu—Al—Mn alloy having a composition of Cu-17 at % Al-11.4 at % Mn. However, although the alloy of Cu-17 at % Al-11.4 at % Mn disclosed in Non-Patent Document 2 has the $L2_1$-type ordered structure, the total of Al and Mn is 28.4%, and thus the degree of order thereof is low. Hence, when deformation is repeated several to about 100 times, satisfactory superelasticity and a satisfactory shape memory effect are shown whereas when deformation is repeated 200 to 1000 times, a residual strain exceeds 2%, and thus the accumulation of the residual strain is disadvantageously remarkable.

Non-Patent Document 3 discloses the alloy single crystal of Cu-20 at % Al-10 at % Mn in which repeated deformation characteristics is enhanced. However, the alloy single crystal of Cu-20 at % Al-10 at % Mn disclosed in Non-Patent Document 2 is produced by a vertical Bridgeman method which is difficult to perform industrially, and thus it disadvantageously takes a long time to produce it. Since a test piece made in Non-Patent Document 2 is so small that its size is 2 mm×2 mm×4 mm, and no matter how excellent the test pieces is in repeated deformation, applicable fields are disadvantageously limited by this size. Furthermore, although the vertical Bridgeman method is a production method in which a hot zone is formed with resistance heating and a heat insulating material and in which a crucible is lowered to gradually lower the temperature and to thereby achieve crystallization within the crucible, it is highly likely that an impurity is mixed from the crucible into the alloy single crystal produced by this method, and thus this serves as a nucleus such that a different crystal orientation is grown to easily form a polycrystal, with the result that desired characteristics cannot often be disadvantageously obtained. Furthermore, the vertical Bridgeman method is not suitable as a method for producing parts or members of a large shape-memory alloy such as a building material whose total length is equal to or greater than, for example, 300 mm. Moreover, the alloy of Cu-20 at % Al-10 at % Mn disclosed in Non-Patent Document 2 has a composition which cannot be subjected to working after its production, and thus, in particular, it is difficult to apply it as a shape-memory alloy used for an industrial product material.

As described above, in the conventional technologies, the accumulation of the crystal orientation or the crystal grain diameter has been controlled to have a predetermined large size, and thus various studies have been conducted on the improvement of the superelasticity and the shape memory effect in the Cu—Al—Mn-based alloy. However, in each of the conventional technologies described above, the repeated deformation resistance including the fatigue resistance and the fracture resistance when the repeated deformation is performed is not sufficient, with the result that it is necessary to further enhance the repeated deformation resistance.

For example, when the Cu—Al—Mn-based alloy is used as a medical device, a building member or the like, the deterioration of characteristics caused by repeated deformation is a major problem, with the result that further improvement is required. In order to use the copper-based alloy material as an in-vehicle part, an aerospace equipment part or the like, it is required that in repeated deformation in which loading and unloading of a stress applying a high strain (for example, a 5% strain) are repeated, the strain be unlikely to be left even after a high number of cycles (for example, the number of cycles is equal to or greater than 1000) and that a technology for further reducing the deterioration of the superelasticity and the shape memory effect be developed.

Hence, an object of the present invention is to provide a copper-based alloy material in which a strain is unlikely to be left and excellent fatigue resistance and fracture resistance are provided, for example, even when deformation where the copper-based alloy material is returned to its original shape after loading of a stress applying a shape-memory alloy-specific strain and unloading thereof is repeated, a production method therefor and members or parts made of the copper-based alloy material.

Means for Solving the Problems

In order to solve the problems described above, the present inventors have conducted thorough studies to find that an appropriate amount of Ni is further added into a Cu—Al—Mn-based alloy material so as to form a multiphase (two-phase) structure in which a B2-type precipitation phase (NiAl precipitation phase) that is not precipitated in a ternary alloy of Cu—Al—Mn (without addition of Ni) is precipitated and dispersed in a matrix of a β phase (crystal structure is preferably any one of an $L2_1$-type structure, an A2-type structure and a B2-type structure) and that thus while a necessary level of workability for an industrial product is being held, it is possible to perform control so as to achieve a higher degree of order than the degree of order of a conventional Cu—Al—Mn alloy material, and to further find that the existence frequency of crystal grain boundaries in a surface (semi-circumferential surface) of the alloy material is controlled, that is, crystal grains are grown to be large enough to form a substantially single crystal and that thus a Cu—Al—Mn—Ni-based alloy material is obtained in which a strain is unlikely to be left and excellent fracture resistance and fatigue resistance are provided even when deformation where the Cu—Al—Mn—Ni-based alloy material is returned to its original shape after loading of a stress applying a predetermined strain and unloading thereof is repeated.

It is also found that the formation of the multiphase structure and the large crystal grains as described above can be achieved by a production method including: a step (step 1) of performing melting and casting; a step (step 5) of further performing, after a step (step 2) of performing hot working is performed and thereafter predetermined intermediate annealing (step 3) and predetermined cold working (step 4) are performed at least one or more times in this order, additional intermediate annealing for stabilizing a B2-type precipitation phase in the matrix of a B phase; a step (step 6) of performing heating to a temperature range in which the state of an (α+β) phase where the amount of a β phase precipitated is fixed in the initial stage of memory heat treatment is achieved and holding the temperature range; a step (step 7) of performing heating to a temperature range in which the state of the (α+β) phase is changed to the state of a β single phase and holding the temperature range; a step (step 8) of performing cooling to a temperature range in which the state of the β single phase is changed to the state of the (α+β) phase and holding the temperature range; and a step (step 10) of performing quenching after a step (step 9) of performing heating to a temperature range in the state of the (α+β) phase is changed to the state of the β single phase and holding the temperature range is repeated at least two or more times. Then, the present invention has been completed based on these findings.

Specifically, the gist of the present invention is directed to the following aspects.

(1) A copper-based alloy material including a multiphase structure including a matrix of a B phase and a precipitation phase of a B2-type crystal structure dispersed in the matrix.

(2) The copper-based alloy material according to aspect (1), in which the matrix includes an A2-type, B2-type or $L2_1$-type crystal structure.

(3) The copper-based alloy material according to aspect (1) or (2), which has a shape-memory alloy characteristic.

(4) The copper-based alloy material according to aspect (1), (2) or (3), which has a composition including 8.6 to 12.6% by mass of Al, 2.9 to 8.9% by mass of Mn, 3.2 to 10.0% by mass of Ni, with the balance being Cu and inevitable impurities.

(5) The copper-based alloy material according to any one of aspects (1) to (4), in which in the alloy material, the direction of working which is the direction of rolling or the direction of wire drawing is the direction of extension, a cross section is substantially circular or substantially polygonal and an elongated shape is provided as a whole, and when a semi-circumferential surface obtained by partitioning the entire circumferential surface which is a surface other than both end surfaces of the alloy material with a pair of end edge half portions which are respectively located in end edges of both the end surfaces and which have a semi-circumferential length corresponding to the length of half the entire circumference of the end edges and a pair of extension line portions which respectively couples both ends of the pair of end edge half portions and which are generatrices or ridge lines of the alloy material is seen, a crystal grain boundary does not exist on the semi-circumferential surface or the existence frequency of the crystal grain boundary is equal to or less than 0.2 even when the crystal grain boundary exists.

(6) The copper-based alloy material according to any one of aspects (1) to (5), in which the residual strain of the alloy material after loading and unloading of a stress applying a 5% strain to the alloy material is repeated 1000 times is equal to or less than 2.0%.

(7) The copper-based alloy material according to any one of aspects (1) to (6), in which when loading and unloading of a stress applying a 3% strain to the alloy material is repeated, the number of times the loading and unloading is repeated until the alloy material is fractured is equal to or greater than 1000.

(8) The copper-based alloy material according to aspect (4), in which the composition further contains a total of 0.001 to 10.000% by mass of one type or two or more types of components selected from the group consisting of 0.001 to 2.000% by mass of Co, 0.001 to 3.000% by mass of Fe, 0.001 to 2.000% by mass of Ti, 0.001 to 1.000% by mass of V, 0.001 to 1.000% by mass of Nb, 0.001 to 1.000% by mass of Ta, 0.001 to 1.000% by mass of Zr, 0.001 to 2.000% by mass of Cr, 0.001 to 1.000% by mass of Mo, 0.001 to 1.000% by mass of W, 0.001 to 2.000% by mass of Si, 0.001 to 0.500% by mass of C and 0.001 to 5.000% by mass of misch metal.

(9) A method for producing a copper-based alloy material, the method including: a step ([step 1]) of melting and casting raw materials of the copper-based alloy material according to aspect (4) or (8) above; a step ([step 2]) of performing hot working; a step ([step 5]) of performing each of a step ([step 3]) of performing intermediate annealing in a first temperature range of 400 to 680° C. and a step ([step 4]) of performing cold working in which a working rate is equal to or greater than 30% at least one or more times in this order and thereafter further performing additional intermediate annealing in a second temperature range of 400 to 550° C.; a step ([step 6]) of performing heating from room temperature to a third temperature range of 400 to 650° C. and holding the third temperature range; a step ([step 7]) of further performing heating from the third temperature range to a fourth temperature range of 700 to 950° C. and holding the fourth temperature range; and a step ([step 10]) of repeating a step ([step 8]) of performing cooling from the fourth temperature range to the third temperature range and holding the third temperature range and a step ([step 9]) of performing heating from the third temperature range to the fourth temperature range and holding the fourth temperature range at least two or more times and thereafter performing quenching from the fourth temperature range.

(10) The method for producing a copper-based alloy material according to aspect (9), the method further including: a step ([step 11]) of performing, after the step ([step 10]) of performing quenching, heating to a fifth temperature range of 80 to 300° C. and holding the fifth temperature range.

(11) A copper-based alloy material including a composition including 8.6 to 12.6% by mass of Al, 2.9 to 8.9% by mass of Mn, 3.2 to 10.0% by mass of Ni, with the balance being Cu and inevitable impurities.

(12) A spring material including the copper-based alloy material according to any one of aspects (1) to (8).

(13) A damper including the copper-based alloy material according to any one of aspects (1) to (8).

(14) A brace including the copper-based alloy material according to in any one of aspects (1) to (8).

(15) A screw or bolt including the copper-based alloy material according to any one of aspects (1) to (8).

(16) An energized actuator including the copper-based alloy material according to any one of aspects (1) to (8).

(17) A magnetic actuator including the copper-based alloy material according to any one of aspects (1) to (8).

(18) A magnetic sensor including the copper-based alloy material according to any one of aspects (1) to (8).

Effects of the Invention

The copper-based alloy material of the present invention includes a multiphase structure in which a precipitation phase of a B2-type crystal structure is dispersed in a matrix of a B phase, and thus in the copper-based alloy material, a strain is unlikely to be left and excellent fatigue resistance and fracture resistance are provided, for example, even when deformation where the copper-based alloy material is returned to its original shape after loading of a stress applying a shape-memory alloy-specific strain and unloading thereof is repeated. A method for producing a copper-based alloy material includes: a step ([step 1]) of melting and casting raw materials of the copper-based alloy material; a step ([step 2]) of performing hot working; a step ([step 5]) of performing each of a step ([step 3]) of performing intermediate annealing in a first temperature range of 400 to 680° C. and a step ([step 4]) of performing cold working in which a working rate is equal to or greater than 30% at least one or more times in this order and thereafter further performing additional intermediate annealing in a second temperature range of 400 to 550° C.; a step ([step 6]) of performing heating from room temperature to a third temperature range of 400 to 650° C. and holding the third temperature range; a step ([step 7]) of further performing heating from the third temperature range to a fourth temperature range of 700 to 950° C. and holding the fourth temperature range; and a step ([step 10]) of repeating a step ([step 8]) of performing cooling from the fourth temperature range to the third temperature range and holding the third temperature range and a step ([step 9]) of performing heating from the third temperature range to the fourth temperature range and holding the fourth temperature range at least two or more times and thereafter performing quenching from the fourth temperature range, with the result that it is possible to provide the copper alloy material excellent in fracture resistance and fatigue resistance.

The copper-based alloy material of the present invention can be used for various members in which superelasticity and a shape memory effect are required, and can also be applied to, for example, an antenna of a mobile telephone, a glasses frame, medical products such as an orthodontic wire, a guide wire, a stent, a pincer nail correction tool (ingrown nail correction tool) and a hallux valgus prosthesis, a connector and an energized actuator. Among them, since the copper-based alloy material of the present invention is excellent in repeated deformation resistance including both fatigue resistance and fracture resistance when repeated deformation is performed, the copper-based alloy material is suitable for members which are intended for vibration damping or attenuation on vibration, members which are intended for suppression or attenuation of noise and members which are intended for self-restoration (self-centering). In particular, the copper-based alloy material can also be applied to members, such as space equipment, aviation equipment, automobile members, building members, electronic parts and medical products, in which repeated deformation resistance is needed and to which a conventional copper-based alloy material is difficult to apply.

Furthermore, the copper-based alloy material of the present invention is suitably used as, for example, on vibration, vibration damping materials such as a spring material, a damper and a bus bar and building materials such as a brace acting as a seismic vibration damping material and connecting parts such as a screw and a bolt. These vibration damping materials and building materials acting as seismic vibration damping materials are used, and thus it is possible to construct vibration damping (seismic vibration damping) structures. Furthermore, by utilization of the characteristic of absorbing vibration as described above, the copper-based alloy material can also be utilized as civil engineering/building materials with which public nuisances of noise and vibration can be prevented. Furthermore, when the copper-based alloy material is intended for the effect of attenuating noise, the copper-based alloy material can also be applied to the field of transportation devices. In any case, excellent self-restoration is provided, and thus the copper-based alloy material can also be used as a self-restoring material. Moreover, since the crystal structure which includes a large amount of Heusler alloy-specific $L2_1$-type ordered structure is provided, excellent magnetic characteristics are provided, and thus the copper-based alloy material can also be applied to new applications such as a magnetic actuator and a magnetic sensor.

PREFERRED MODE FOR CARRYING OUT THE INVENTION

Figure 1A:
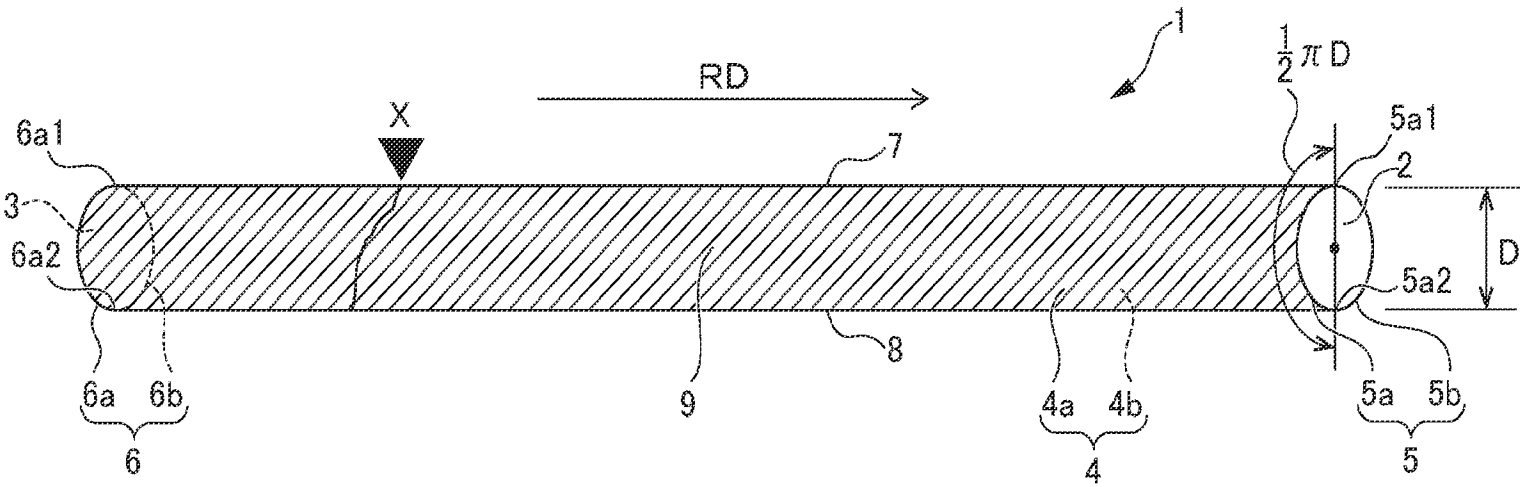
FIGS. 1(*a*) and 1(*b*) are perspective views schematically showing two types of copper-based alloy material according to the present invention and having different shapes, FIG. 1(*a*) shows a case where the copper-based alloy material is the shape of a round bar and FIG. 1(*b*) shows a case where the copper-based alloy material is in the shape of a plate.

A preferred embodiment of a copper-based alloy material according to the present invention will then be described in detail below.

<Copper-Based Alloy Material>

(Metal Structure of Copper-Based Alloy Material)

The copper-based alloy material of the present invention has a multiphase structure in which the precipitation phase of a B2-type crystal structure is dispersed in the matrix (parent phase) of a β phase. In other words, although the copper-based alloy material of the present invention includes the precipitation phase, the copper-based alloy material has a recrystallized structure substantially formed from a β single phase. Here, the "has a recrystallized structure substantially formed from a β single phase" means that the volume ratio of the β phase forming the matrix (parent phase) in the recrystallized structure is equal to or greater than 80% and preferably equal to or greater than 90%.

The copper-based alloy material of the present invention is formed from a quaternary copper-based alloy which has, for example, Al, Mn and Ni as basic components. This alloy has a β phase β body-centered cubic) single phase β also simply referred to as the "β single phase" in the present specification) at a high temperature whereas the alloy has a two-phase structure (also simply referred to as the "(α+β) phase" in the present specification) of the β phase and an α phase (face-centered cubic) at a low temperature. Although a difference is produced depending on the alloy composition, a temperature at which the β single phase is formed is normally a high temperature range equal to or greater than 700° C. and equal to or less than 950° C. without melting whereas a temperature at which the (α+β) phase is formed is normally a low temperature range less than 700° C. In this alloy, in a non-equilibrium state, the (α+β) phase is formed even at room temperature, and thus the lower limit temperature of the temperature range in which the (α+β) phase is formed is not particularly limited.

When a copper-based alloy material formed from a ternary alloy of Cu—Al—Mn is produced by combination of its composition and a conventional production method, a single-phase structure formed from the β phase having an ordered structure $L2_1$-type crystal structure is formed. By contrast, when the copper-based alloy material of the present invention, for example, the copper-based alloy material formed from the quaternary copper-based alloy which has Al, Mn and Ni as basic components is produced by combination of its composition and the novel production method of the present invention, a multiphase (two-phase) structure in which the precipitation phase (NiAl precipitation phase) of the B2-type crystal structure is precipitated and dispersed in the matrix (parent phase) of the β phase is formed, and the multiphase structure as described above is formed to be able to enhance repeated deformation resistance in which a strain is unlikely to be left and both fracture resistance and fatigue resistance are included even when deformation where the copper-based alloy material is returned to its original shape after loading of a stress applying a shape-memory alloy-specific strain and unloading thereof is repeated.

The β phase forming the matrix is preferably an A2-type, B2-type or $L2_1$-type crystal structure, and among them, in particular, a shape-memory alloy more preferably has a Heusler $L2_1$-type crystal structure in that excellent superelasticity is known to be provided and repeated deformation resistance is stably obtained.

In the copper-based alloy material of the present invention, the alloy composition and the steps and conditions of the production method are optimized, and thus the multiphase structure which has not so far existed and in which the precipitation phase of the B2-type crystal structure is dispersed in the matrix (parent phase) of the β phase can be provided.

The copper-based alloy material of the present invention not only stably shows the superelasticity and a shape memory effect in the early stage of deformation but also can control, even when high strain deformation (for example, deformation caused by loading and unloading of a stress applying a 5% strain to the alloy material) is repeated 1000 times, a residual strain after the repeated deformation such that the residual strain is equal to or less than 2.0%, with the result that it is possible to significantly enhance the fatigue resistance.

In addition to the characteristics described above, the copper-based alloy material of the present invention can withstand a fracture even when the number of times the deformation is performed reaches a large number of times (the number of times until the occurrence of a fracture when loading and unloading of a stress applying a 3% strain to the alloy material is repeated is equal to or greater than 1000, and hereinafter the number of times until the occurrence of a fracture equal to or greater than 1000 is also simply referred to as a "large number of times"), with the result that it is possible to significantly enhance the fracture resistance. As described above, the copper-based alloy material of the present invention can achieve unpredictable and remarkable effects as compared with a conventional copper-based alloy material.

(Control of Crystal Structure and Analysis Method Thereof)

In the copper-based alloy material of the present invention, it is important that the metal structure thereof has the recrystallized structure substantially formed from the β phase (bcc structure) and that, more specifically, the metal structure has the two-phase structure of the β phase (of the matrix) and the precipitation phase. In particular, the crystal structure of the β phase forming the matrix (parent phase) is the A2-type, B2-type or $L2_1$-type, though it has so far been impossible to perform working when the concentration of Al is increased to increase the degree of order, Ni is added to precipitate the α phase at an intermediate temperature without lowering the degree of order so as to be able to perform working and furthermore, it is possible to enhance fatigue strength by precipitation enhancement action produced by precipitating the precipitation phase of the B2-type (for example, NiAl) crystal structure in the matrix. The control of the crystal structure in the present invention can be performed by appropriately setting the alloy composition and the steps and conditions of the production method.

Since it was difficult to analyze the detailed crystal structure of the β phase by measurement of X-ray diffraction (hereinafter referred to as "XRD"), in the present invention, a measurement was made with a transmission electron microscope (hereinafter referred to as the "TEM"). A method for making a measurement sample and measurement conditions will be described below.

A sample of a plate material having a thickness of about 80 μm was made by wet polishing of a test material, and a mixed solution of phosphoric acid:ethanol:propanol:distilled water=5:5:1:10 (volume fraction) was used to perform electropolishing with a voltage of 14.0 V and a current of 150 mA at a temperature of 0° C. by use of TenuPol-5 made by Struers. For the measurement, JEM-2100 (HC) made by JEOL Ltd. was used to measure an electron diffraction pattern and a dark-field image. Samples were made with the copper-based alloy materials of Example 1 and Comparative Example 23.

As a result of the analysis of the electron diffraction pattern and the dark-field image with the TEM, in Example 1, the electron diffraction pattern strongly showed an $L2_1$-type ordered phase, and in the dark-field image, it was confirmed that several nm of an NiAl precipitate existed. On the other hand, in the electron diffraction pattern of Comparative Example 23, the diffraction intensity of an $L2_1$-type ordered phase was low as compared with Example 1, and in the dark-field image, the existence of a precipitation phase was not confirmed.

(Definition of Crystal Grain Diameter and Control Thereof)

It is considered that the conventional copper-based alloy material produced as a shape-memory alloy preferably has a crystal structure called a bamboo structure. The "bamboo structure" described here refers to a structure state where only large crystal grains of small and large crystal grains are controlled, where for example, when crystal grains existing in the surface or cross section of a copper alloy material (specimen) in the shape of a round bar are observed, coarsening control is performed such that the large crystal grains are larger than the diameter of the specimen and where thus a plurality of crystal grain boundaries existing between the coarsened large crystal grains are seen as if they were bamboo sections existing at intervals along the longitudinal direction of the copper-based alloy material, and the "bamboo structure" is also called a bamboo organization.

Since in the copper-based alloy material having the bamboo structure, only the large crystal grains can be controlled and the small crystal grains cannot be controlled, when repeated deformation is performed several times, satisfactory superelasticity is shown whereas when repeated deformation is performed a large number of times, a residual strain is accumulated in the grain boundaries, and thus sufficient fatigue resistance is not obtained. Hence, the number of small crystal grains existing in the copper-based alloy material attempts to be minimized, and it is found that the existing amount of small crystal grains is controlled and that thus the residual strain can be restricted to be small even when repeated deformation is performed a large number of times.

However, it is found that when in the copper-based alloy material, not the small crystal grains but the large crystal grains which form the so-called bamboo organization exist in large numbers, the number of times until the occurrence of a fracture is limited, and that thus poor fracture resistance is provided. In other words, when the existing amount of small crystal grains is only controlled, and the existing amount of large crystal grains forming the bamboo organization is large, the fracture resistance of the copper-based alloy material is lowered, and the number of times until the occurrence of a fracture is decreased, with the result that it is found that when repeated deformation is performed, the copper-based alloy material is fractured in the early stage.

Hence, preferably, the copper-based alloy material of the present invention is controlled such that only the large crystal grains exist and that the existence frequency of crystal grain boundaries between the large crystal grains existing in the specimen, and more specifically, in the copper-based alloy material, the direction of working which is the direction of rolling or the direction of wire drawing is the direction of extension, a cross section is substantially circular or substantially polygonal and an elongated shape is provided as a whole, and when a semi-circumferential surface obtained by partitioning the entire circumferential surface which is a surface other than both end surfaces of the alloy material with a pair of end edge half portions which are respectively located in end edges of both the end surfaces and which have a semi-circumferential length corresponding to the length of half the entire circumference of the end edges and a pair of extension line portions which respectively couples both ends of the pair of end edge half portions and which are generatrices or ridge lines of the alloy material is seen, a crystal grain boundary does not exist on the semi-circumferential surface or the existence frequency of crystal grain boundaries is equal to or less than 0.2 even when the crystal grain boundary exists, with the result that the fracture resistance is further enhanced. The existence frequency of crystal grain boundaries is more preferably equal to or less than 0.1.

Figure 1B:
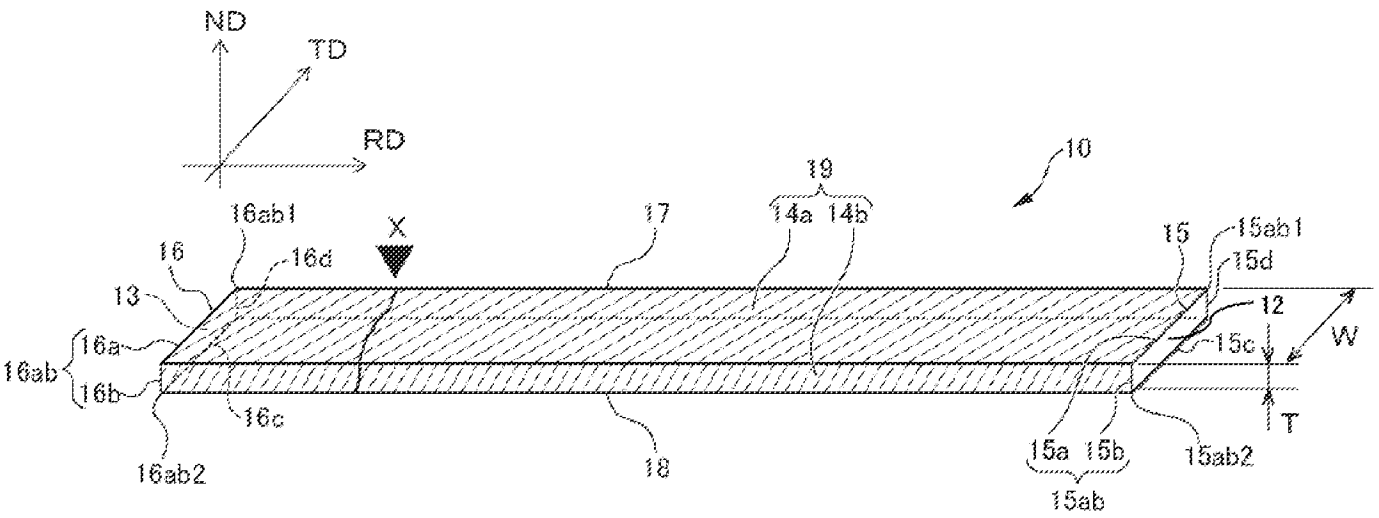

FIGS. 1(*a*) and 1(*b*) are perspective views schematically showing two types of copper-based alloy material according to the present invention and having different shapes, FIG. 1(*a*) shows a case where the copper-based alloy material is in the shape of a round bar and FIG. 1(*b*) shows a case where the copper-based alloy material is in the shape of a plate.

In the copper-based alloy material (specimen) 1, the direction of working RD which is the direction of rolling or the direction of wire drawing is the direction of extension, a cross section is substantially circular and an elongated shape (the shape of a round bar in FIG. 1(*a*)) is provided as a whole, and when a semi-circumferential surface (region indicated by oblique lines in FIG. (a)) 9 obtained by partitioning the entire circumferential surface 4 which is a surface other than both end surfaces 2 and 3 of the alloy material 1 with a pair of end edge half portions 5*a* and 6*a* which are respectively located in the end edges 5 and 6 of both the end surfaces 2 and 3 and which have a semi-circumferential length corresponding to the length of half the entire circumference of the end edges 5 and 6 and a pair of extension line portions 7 and 8 which respectively couples both ends 5*a*1 and 6*a*1 and both ends 5*a*2 and 6*a*2 of the pair of end edge half portions 5*a* and 6*a* and which are generatrices of the alloy material 1 is seen, it is preferable that a crystal grain boundary X does not exist on the semi-circumferential surface 9 or the existence frequency P of crystal grain boundaries X is equal to or less than 0.2 even when the crystal grain boundary X exists.

Specifically, for the existence frequency P of crystal grain boundaries X, 20 pieces (N=20) of copper-based alloy material (specimens) 1 were prepared, the existence number n of crystal grain boundaries X existing in the semi-circumferential surface 9 of each of the specimens 1 was counted and the existence frequency P thereof was calculated.

For example, when the existence number n1 of crystal grain boundaries X is 1 in one out of the twenty specimens, and the crystal grain boundary X does not exist in each of the remaining nineteen specimens (zero in each of n2, n3, . . . and n20), the existence frequency P calculated from the existence number n (=n1+n2+ . . . +n20) of crystal grain boundaries X is 0.05 as a result of calculation of (n=1)/(N=20).

When the existence number of crystal grain boundaries X is 1 in four or less out of the twenty specimens, and the crystal grain boundary X does not exist in each of the remaining sixteen or more specimens, the existence frequency P calculated from the existence number n of crystal grain boundaries X is equal to or less than 0.20 as a result of calculation of (n≤4)/(N=20).

In the copper-based alloy material (specimen) 10, the direction of working RD which is the direction of rolling or the direction of wire drawing is the direction of extension, a cross section is substantially polygonal and an elongated shape (the shape of a plate having a cross section of a quadrangle in FIG. 1(*b*)) is provided as a whole, and when a semi-circumferential surface (region (two surfaces of a surface 14*a* and a surface 14*b*) indicated by oblique lines in FIG. 1(*b*)) 19 obtained by partitioning the entire circumferential surface which is the entire circumferential surface other than both end surfaces 12 and 13 of the alloy material 10 and which is formed from four surfaces in FIG. 1(*b*) with a pair of end edge half portions 15*ab* and 16*ab* which are respectively located in the end edges 15 and 16 of both the end surfaces 12 and 13 and which have a semi-circumferential length corresponding to the length of half the entire circumference of the end edges 15 and 16 and a pair of extension line portions 17 and 18 which respectively couples both ends 15*ab*1 and 16*ab*1 and both ends 15*ab*2 and 16*ab*2 of the pair of end edge half portions 15*ab* and 16*ab* and which are ride lines of the alloy material 1 is seen, it is preferable that the crystal grain boundary X does not exist on the semi-circumferential surface 19 or the existence frequency P of crystal grain boundaries X is equal to or less than 0.2 even when the crystal grain boundary X exists.

In the copper-based alloy material of the present invention, a surface portion is substantially higher in the degree of working than a center portion due to the influences of an additional shear stress and a tool surface friction in the step of working such that crystal grains are more likely to be fine, and thus it can be considered that when crystal grains existing in the surface portion satisfy the existence frequency P of crystal grain boundaries X described above, crystal grains existing in the center portion also satisfy it, with the result that in the present invention, evaluations are performed in the surface of the copper-based alloy material.

Figure 2A:
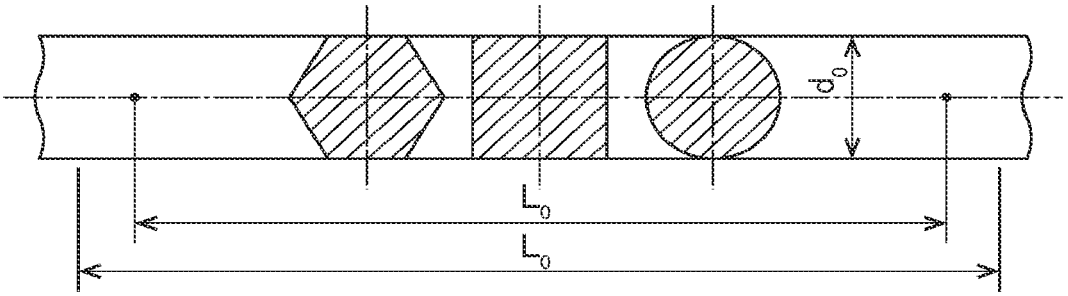
FIGS. 2(*a*) to 2(*c*) show the shapes of test pieces made for measuring the number of crystal grain boundaries existing in the copper-based alloy material of the present invention and mechanical characteristics, FIG. 2(*a*) shows a case where the test piece is a bar material whose diameter or side is equal to or greater than 4 mm, FIG. 2(*b*) shows a case where the test piece is a bar material (or a wire material) whose diameter or side is less than 4 mm and FIG. 2(*c*) shows a case where the test piece is a plate material.
Figure 2B:
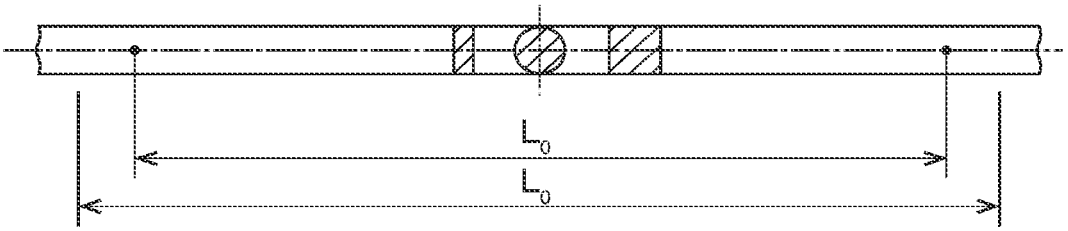
Figure 2C:
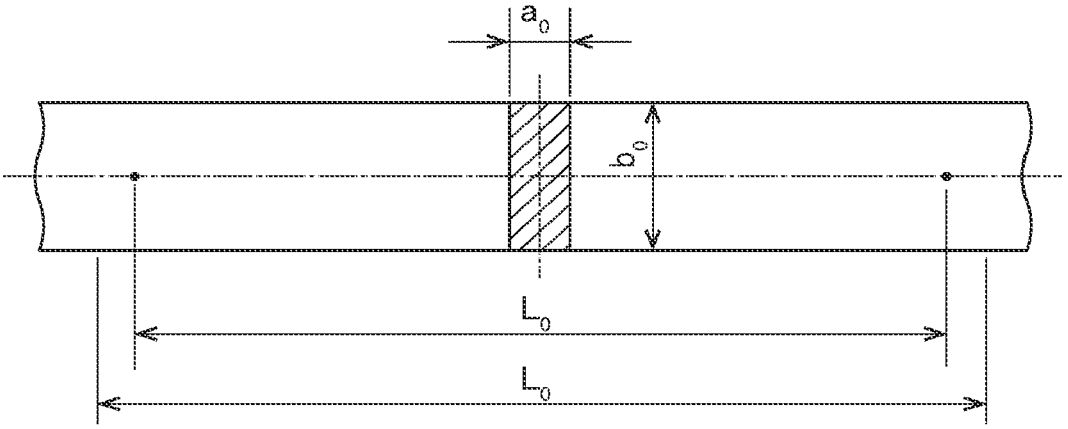

With respect to the shapes of the specimens of the copper-based alloy material of the present invention, the examples of a bar material, a wire material and a plate material are respectively shown in FIGS. 2(*a*) to 2(*c*). The shapes of the specimens shown in FIGS. 2(*a*) to 2(*c*) conformed to the shapes of tensile test pieces specified in JIS Z2241:2011, in the case of the round bar shown in FIG. 2(*a*), the shape of JIS No. 2 test piece was adopted, in the case of the wire material shown in FIG. 2(*b*), the shape of JIS No. 9B test piece was adopted, in the case of the plate material shown in FIG. 2(*c*), the shape of JIS No. 1B test piece in which tapering (R) was not performed was adopted and the existence frequency P of crystal grain boundaries X was measured from the existence number n of crystal grain boundaries X in the semi-circumferential surface of a parallel portion length Lc. After the measurement of the existence number n of crystal grain boundaries X, the specimens were used as specimens for fatigue resistance and fracture resistance without their shapes being changed. It is confirmed that the copper-based alloy material of the present invention has a multiphase (two-phase) structure of the matrix of the β phase and the precipitation phase of the B2-type crystal structure, and that when existence frequency P≤0.2, excellent fatigue resistance is provided regardless of the shape of the specimen. It is also confirmed that, regardless of which one of the bar material and the plate material is used, even when the copper-based alloy material of the present invention is thereafter worked into a device shape, the same excellent fatigue resistance is provided, and thus the present invention is not limited to the shapes described above. With respect to characteristic evaluations and structure observations in the present invention, unless otherwise specified, the specimens having the shape of JIS No. 9B test piece shown in FIG. 2(*b*) were made, and the characteristic evaluations and the structure observations were performed.

Examples of the dimensions of the specimens shown in FIGS. 2(*a*) to 2(*c*) are shown below.

[In case of round bar shown in FIG. 2(*a*)]

diameter $d_o$: 16 mm, total length Lt: 300 mm (parallel portion length Lc: 250 mm)

[In case of wire material shown in FIG. 2(*b*)]

diameter $d_o$: 3 mm, total length Lt: 300 mm (parallel portion length Lc: 250 mm)

[In case of plate material shown in FIG. 2(*c*)]

thickness $a_o$: 0.2 mm, width $b_o$: 25 mm, total length Lt: 300 mm (parallel portion length Lc: 250 mm)

In the copper-based alloy material of the present invention, when the semi-circumferential surface described above is seen, the existence number n of crystal grain boundaries X is preferably equal to or less than 1, and is optimally 0. This is because when the existence number n of crystal grain boundaries X is equal to or greater than 2, the copper-based alloy material has the bamboo structure as with the conventional copper-based alloy material so as to tend to be inferior in fatigue resistance and fracture resistance.

(Shape and the Like of Copper-Based Alloy Material)

The copper-based alloy material of the present invention is a shaped material which is elongated in the direction of working (RD). As described previously, in a case where the alloy material is the plate material, the direction of working (RD) means the direction of rolling when rolling is performed on the alloy material whereas in a case where the alloy material is the bar material (or the wire material), the direction of working (RD) means the direction of wire drawing when wire drawing is performed on the alloy material. Although the alloy material of the present invention is elongated in the direction of working (RD), the longitudinal direction of the alloy material and the direction of working do not always need to coincide with each other. When the copper-based alloy material of the present invention having an elongated shape is subjected to working such as cutting/bending, with consideration given to which direction the original direction of working of the alloy material is, whether or not the copper-based alloy material subjected to the working is included in the copper-based alloy material of the present invention is determined. The specific shape of the copper-based alloy material of the present invention is not particularly limited, and, for example, various shapes such as a bar (wire) and a plate (strip) can be adopted. Although the sizes thereof are not particularly limited, for example, when the copper-based alloy material is the bar material (including the wire material), the size can be set such that the diameter is 0.1 to 50 mm, and depending on the application, the size can be set such that the diameter is 8 to 16 mm. When the copper-based alloy material is the plate material, the thickness thereof may be equal to or greater than 0.2 mm, for example, 0.2 to 15 mm. In the copper-based alloy material of the present invention, instead of wire drawing, rolling is performed so as to be able to obtain the plate material (strip material) In the present invention, the copper-based alloy material (specimens) whose length (total length) was equal to or greater than 400 mm was prototyped, and it was confirmed that the existence frequency P of crystal grain boundaries X was zero, that was, the crystal grain boundary X did not exist in all the semi-circumferential surfaces of 20 specimens and that in other words, all the 20 specimens were formed from a single crystal.

The bar material of the present invention is not limited to the round bar (round wire), and may be a square bar (square wire) or a rectangular bar (rectangular wire). Here, in order to obtain the square bar (square wire), for example, rectangular wire working such as cold working using a working machine, cold working using a cassette roller die, pressing or drawing may be performed according to an ordinary method on the round bar (round wire) previously obtained by the method described above. A cross-sectional shape obtained by the rectangular wire working is adjusted as necessary, and thus the square bar (square wire) whose cross-sectional shape is square and the rectangular bar (rectangular wire) whose cross-sectional shape is rectangular can be made separately. Furthermore, the bar material (wire material) of the present invention may have the shape of a pipe having a hollow pipe wall or the like.

(Composition of Copper-Based Alloy Material)

While the copper-based alloy material of the present invention may have any composition as long as it has the multiphase structure described above, a preferred example of the copper-based alloy material of the present invention may have a composition including 8.6 to 12.6% by mass of Al, 2.9 to 8.9% by mass of Mn, 3.2 to 10.0% by mass of Ni, with the balance being Cu and inevitable impurities when it is a Cu—Al—Mn—Ni-based alloy material. The copper-based alloy material of the composition described above is excellent in hot workability and cold workability, in cold working, a working rate of 20% or more can be achieved and thus in addition to a bar (wire) and a plate (strip), the copper-based alloy material can be molded into an extra fine wire, foil, a pipe and the like into which it is difficult to work a conventional ordered structure alloy.

The reasons why the composition is limited to the composition range described above will be described below.

[Al: 8.6 to 12.6% by Mass]

Al (aluminum) is an element which extends the formation region of the β phase so as to most affect the degree of order in the copper alloy of the present invention, and in order to achieve this action, an Al content is preferably equal to or greater than 8.6% by mass. When the Al content is less than 8.6% by mass, it is likely that the β single phase cannot be sufficiently formed. When the Al content is greater than 12.6% by mass, an ordered structure $L2_1$-type β phase can easily be obtained but the structure at the time of cold working is also an ordered structure, with the result that the alloy material tends to become brittle so as to degrade workability. Although the suitable content range of Al is changed according to a Mn content, when Mn is in the suitable content range which is limited below, the suitable content range of Al is 8.6 to 12.6% by mass.

[Mn: 2.9 to 8.9% by Mass]

Mn (manganese) is an element which has the action of extending the existence range of the β phase to the low side of Al so as to significantly enhance cold workability and to thereby facilitate molding, and in order to achieve this action, the Mn content is preferably equal to or greater than 2.9% by mass. It is not preferable that the Mn content is less than 2.9% by mass because satisfactory workability cannot be obtained, the region of the β single phase cannot be formed and the (α+β) phase is formed. When the Mn content is greater than 8.9% by mass, there is a tendency that a sufficient shape recovery characteristic cannot be obtained. Hence, the suitable content range of Mn is 2.9 to 8.9% by mass.

[Ni: 3.2 to 10.0% by Mass]

Ni (nickel) is an element which has the action of facilitating the formation of a multiphase (two-phase) structure of a stable ordered structure $L2_1$-type and the precipitation phase of the B2-type crystal structure, and in order to achieve this action, a Ni content is preferably equal to or greater than 3.2% by mass. When the Ni content is less than 3.2% by mass, the amount of precipitation phase is not sufficient, an $L2_1$-type single phase is formed so as to lower the degree of order, with the result that there is a tendency that sufficient fatigue resistance cannot be obtained. When the Ni content is greater than 10.00% by mass, the α phase is easily left, and there is a tendency that the region of the β single phase cannot be formed, with the result that it is likely that a sufficient shape recovery characteristic cannot be obtained. Although the suitable content range of Ni is changed according to the contents of Al and Mn, when Al and Mn are in the suitable content ranges limited above, the suitable content range of Ni is 3.2 to 10.0% by mass.

Although the Cu—Al—Mn—Ni-based alloy material of the present invention has Al, Mn and Ni as essential basic components, the Cu—Al—Mn—Ni-based alloy material can further contain, as arbitrary sub-additive components, a total of 0.001 to 10.000% by mass of one type or two or more types of components selected from the group consisting of 0.001 to 2.000% by mass of Co, 0.001 to 3.000% by mass of Fe, 0.001 to 2.000% by mass of Ti, 0.001 to 1.000% by mass of V, 0.001 to 1.000% by mass of Nb, 0.001 to 1.000% by mass of Ta, 0.001 to 1.000% by mass of Zr, 0.001 to 2.000% by mass of Cr, 0.001 to 1.000% by mass of Mo, 0.001 to 1.000% by mass of W, 0.001 to 2.000% by mass of Si, 0.001 to 0.500% by mass of C and 0.001 to 5.000% by mass of misch metal. These components can achieve the effect of enhancing the strength of the copper-based alloy material while maintaining satisfactory cold workability. A total of the contents of these additive elements is preferably 0.001 to 10.000% by mass and particularly preferably 0.001 to 5.000% by mass. When the total of the contents of these components is greater than 10.000% by mass, a martensitic transformation temperature is lowered, and thus the structure of the β single phase becomes unstable.

[0.001 to 2.000% by Mass of Co, 0.001 to 3.000% by Mass of Fe and 0.001 to 2.000% by Mass of Ti]

Co (cobalt), Fe (iron) and Ti (titanium) are elements which are effective in strengthening a base structure. Co has the action of forming a Co—Al intermetallic compound so as to coarsen crystal grains, and in order to achieve this action, a Co content is preferably equal to or greater than 0.001% by mass. When the Co content is greater than 2.000% by mass, the toughness of the copper-based alloy material may be lowered to make it difficult to perform working, and thus the suitable content range of Co is 0.001 to 2.000% by mass. Fe is an element which has the action of precipitating a microstructure so as to strengthen the base structure, and in order to achieve this action, a Fe content is preferably equal to or greater than 0.001% by mass. When the Fe content is greater than 3.000% by mass, the toughness may be lowered to make it impossible to perform working, and thus the suitable content range of Fe is 0.001 to 3.000% by mass. Ti is an element which has the action of precipitating $Cu_2AlTi$ as a stable phase so as to strengthen the base structure, and in order to achieve this action, a Ti content is preferably equal to or greater than 0.001% by mass. When the Ti content is greater than 2.000% by mass, the amount of precipitate tends to be excessive so as to degrade a shape recovery rate, and thus the suitable content range of Ti is 0.001 to 2.000% by mass.

[0.001 to 1.000% by Mass of V, 0.001 to 1.000% by Mass of Nb, 0.001 to 1.000% by Mass of Mo, 0.001 to 1.000% by Mass of Ta and 0.001 to 1.000% by Mass of Zr]

V (vanadium), Nb (niobium), Mo (molybdenum), Ta (tantalum) and Zr (zirconium) are elements which have the effect of increasing hardness and have the action of enhancing wear resistance, and since these elements are unlikely to be solid-dissolved in a base, they are precipitated as the β phase (bcc crystal) so as to be able to enhance strength. The contents of V, Nb, Mo, Ta and Zr for achieving the action described above are each 0.001% by mass. When the contents of V, Nb, Mo, Ta and Zr are each equal to or greater than 1.000% by mass, cold workability may be degraded, and thus the suitable content ranges of V, Nb, Mo, Ta and Zr are each 0.001 to 1.000% by mass.

[0.001 to 2.000% by Mass of Cr]

Cr (chromium) is an element which is effective in maintaining wear resistance and corrosion resistance, and in order to achieve this action, a Cr content is preferably equal to or greater than 0.001% by mass. When the Cr content is greater than 2.000% by mass, a transformation temperature may be significantly lowered, and thus the suitable content range of Cr is 0.001 to 2.000% by mass.

[0.001 to 2.000% by Mass of Si]

Si (silicon) is an element which has the action of enhancing the corrosion resistance, and in order to achieve this action, a Si content is preferably equal to or greater than 0.001% by mass. When the Si content is greater than 2.000% by mass, superelasticity may be degraded, and thus the suitable content range of Si is 0.001 to 2.000% by mass.

[0.001 to 1.000% by Mass of W]

W (tungsten) is an element which has the action of strengthening precipitation because W is unlikely to be solid-dissolved in the base, and in order to achieve this action, a W content is preferably equal to or greater than 0.001% by mass. When the content of W is equal to or greater than 1.000% by mass, the cold workability may be degraded, and thus the suitable content range of W is 0.001 to 1.000% by mass.

[0.001 to 0.500% by Mass of C]

C (carbon) is an element which has the action of obtaining a pinning effect when an appropriate amount is provided so as to more coarsen the crystal grains, and in particular, C is preferably added together with Ti and Zr. In order to achieve this action, a C content is preferably equal to or greater than 0.001% by mass. When the C content is greater than 0.500% by mass, there is a possibility that the crystal grains are unlikely to be coarsened by the opposite effect of pinning, and thus the suitable content range of C is 0.001 to 0.500% by mass.

[0.001 to 5.000% by Mass of Misch Metal]

Misch metal is an element which has the action of obtaining the pinning effect when an appropriate amount is provided so as to more coarsen the crystal grains, and in order to achieve this action, a misch metal content is preferably equal to or greater than 0.001% by mass. When the misch metal content is greater than 5.000% by mass, there is a possibility that the crystal grains are unlikely to be coarsened by the opposite effect of pinning, and thus the suitable content range of misch metal is 0.001 to 5.000% by mass. The "misch metal" refers to an alloy of a rare earth element, such as La (lantern), Ce (cerium) or Nd (neodymium), which is difficult to separate singly.

[Cu and Inevitable Impurities]

The remainder other than the components described above is Cu and inevitable impurities. As used herein, the term "inevitable impurity" means an inclusion level of impurity which can be inevitably included in production steps. Examples of the inevitable impurities include O, N, H, S, P and the like. For example, when a total amount of inevitable impurity component is equal to or less than 0.10% by mass, the content of the inevitable impurity does not affect the characteristics of the copper-based alloy material of the present invention.

(Physical Properties of Copper-Based Alloy Material)

The copper-based alloy material of the present invention has physical properties below. The copper-based alloy material of the present invention is excellent in both fatigue resistance and fracture resistance when deformation where the copper-based alloy material is returned to its original shape after loading of a stress applying a shape-memory alloy-specific strain and unloading thereof is repeated.

Figure 3:
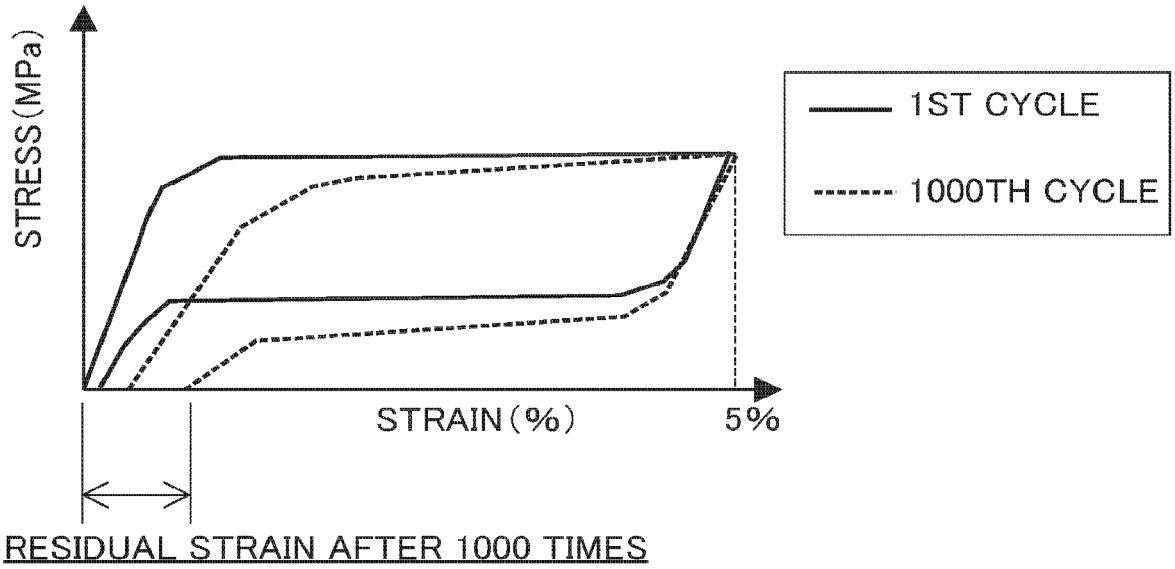
FIG. 3 is stress-strain curves (S-S curves) when deformation caused by loading and unloading of a stress corresponding to a 5% strain is applied to the copper-based alloy material of the present invention, and shows a case (1st cycle) where the cycle of loading and unloading of the stress is performed only once (number of repeated cycles: 1) and a case (1000th cycle) where the cycle is repeated 1000 times (number of repeated cycles: 1000)

Here, the "excellent in fatigue resistance" described in the present invention specifically means that a residual strain of the alloy material after loading and unloading of a stress applying a 5% strain to the alloy material is repeated 1000 times is equal to or less than 2.0% and more preferably equal to or less than 1.4%. FIG. 3 shows an example of a stress-strain curve in each of the 1st cycle and the 1000th cycle when an operation of loading the stress on the copper-based alloy material and unloading it is one cycle. Although the lower limit value of the residual strain is not particularly limited, the lower limit value is normally equal to or greater than 0.1%. The "residual strain" means the amount of strain left after loading and unloading in which a predetermined amount of strain is caused is repeated, and in the present invention, it is defined that as the residual strain is decreased, more excellent fatigue resistance is provided.

Figure 4:
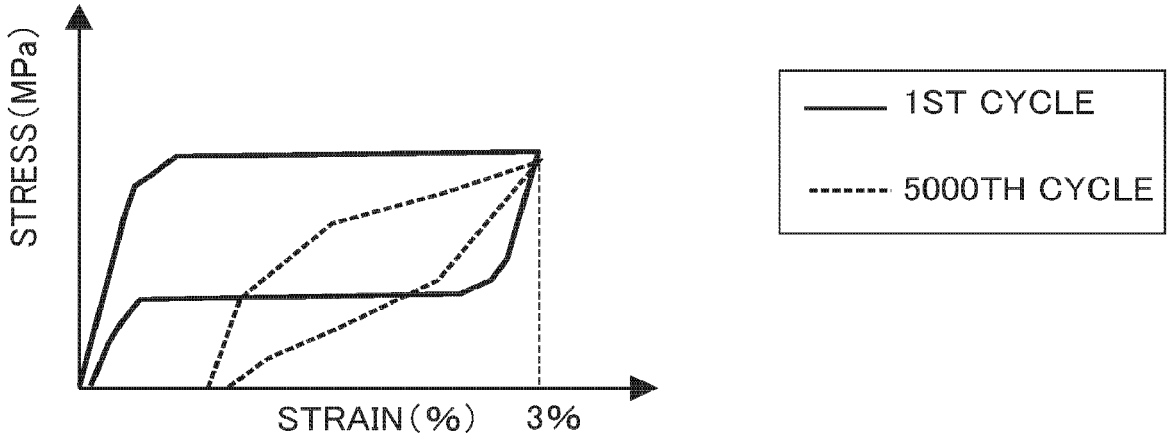
FIG. 4 is stress-strain curves (S-S curves) when deformation caused by loading and unloading of a stress corresponding to a 3% strain is applied to the copper-based alloy material of the present invention, and shows a case (1st cycle) where the cycle of loading and unloading of the stress is performed only once (number of repeated cycles: 1) and a case (5000th cycle) where the cycle is repeated 5000 times (number of repeated cycles: 5000)

The "excellent in fracture resistance" described in the present invention specifically means that when loading and unloading of a stress applying a 3% strain to the alloy material is repeated, the number of times the loading and unloading is repeated until the alloy material is fractured is equal to or greater than 1000. When the number of times the loading and unloading is repeated reaches 5000, the test is completed. FIG. 4 shows an example of a stress-strain curve in each of the 1st cycle and the 5000th cycle when the operation of loading the stress on the copper-based alloy material and unloading it is one cycle. In the present invention, it is defined that as the number of times the loading and unloading is repeated is increased, more excellent fracture resistance is provided. Furthermore, it is preferable to decrease variations in the number of times the loading and unloading is repeated.

With respect to the "variations in the number of times the loading and unloading is repeated", in the present invention, for example, as a result of the measurements of specimens of N=5 under the same production conditions, when the number of times loading and unloading of a stress applying a strain is repeated until the occurrence of a fracture is 5000, if all the specimens are not fractured (the measurements are completed at the time of 5000 times), it is determined that the fracture resistance is excellent. When the number of times the loading and unloading is repeated is equal to or greater than 1000 in all the specimens (for example, in the measurements of N=5, the minimum value is 4412, and the maximum value is 5000), it is determined that the fracture resistance is satisfactory. On the other hand, although in five measurements, part of the specimens are not fractured when the number of times the loading and unloading is repeated is equal to or greater than 1000, if one specimen is fractured when the number of times the loading and unloading is repeated is less than 1000, it is determined that the fracture resistance is poor because variations in the number of times the loading and unloading is repeated are produced until the fracture.

<Method for Producing Copper-Based Alloy Material>

Then, as an example of a method for producing the copper-based alloy material according to the present invention, a preferred method for producing a Cu—Al—Mn—Ni-based alloy material will be described below. The method for producing the copper-based alloy material according to the present invention includes: a step ([step 1]) of performing melting and casting; a step ([step 2]) of performing hot working; a step ([step 3]) of performing intermediate annealing; a step ([step 4]) of performing cold working; a step ([step 5]) of performing additional intermediate annealing; a step ([step 6]) of performing heating to a third temperature range and holding the third temperature range; a step ([step 7]) of performing heating to a fourth temperature range and holding the fourth temperature range; a step ([step 8]) of performing cooling from the fourth temperature range to the third temperature range and holding the third temperature range; a step ([step 9]) of performing heating from the third temperature range to the fourth temperature range and holding the fourth temperature range; and a step ([step 10]) of performing quenching from the fourth temperature range.

Figure 5:
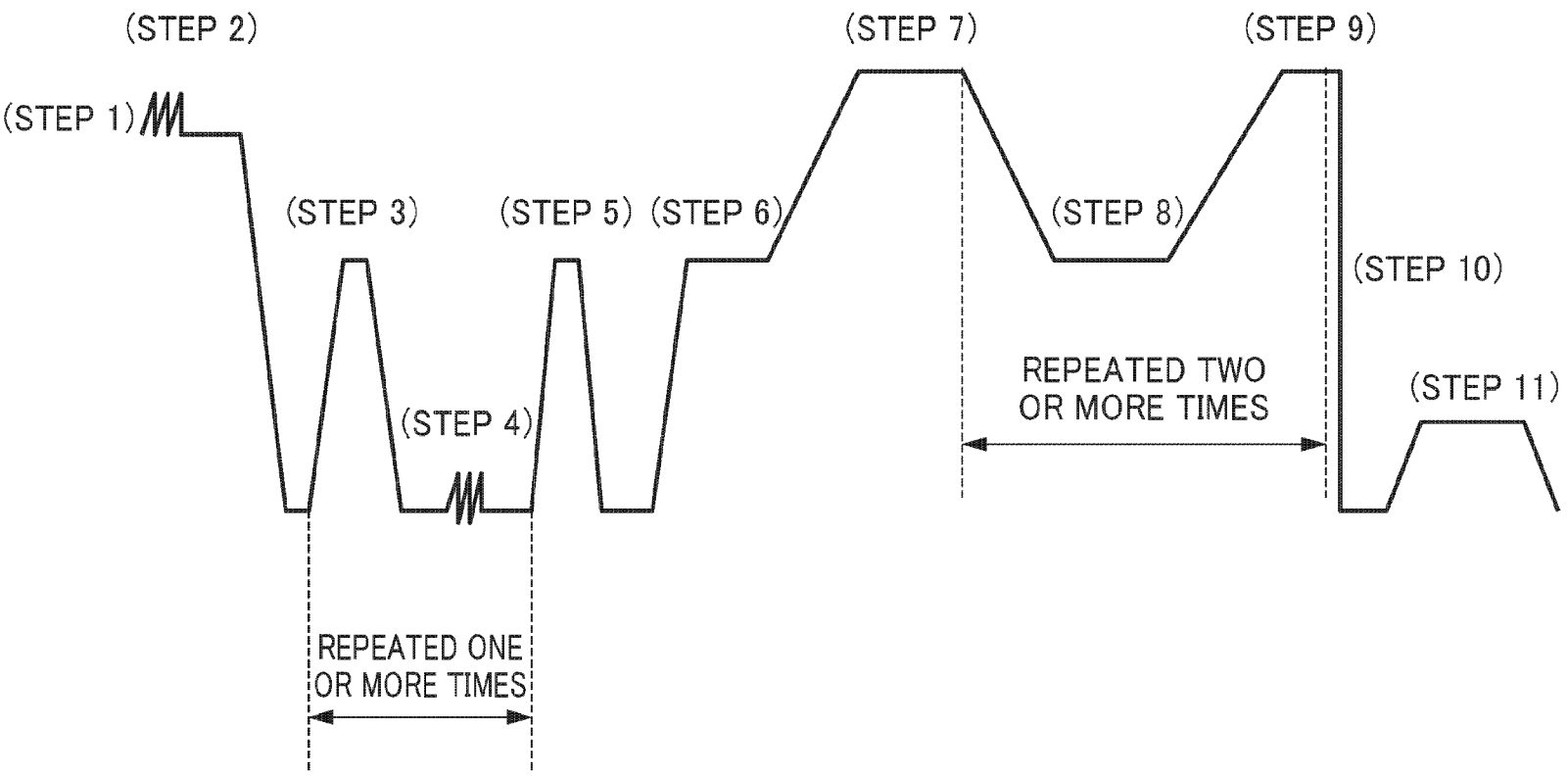
FIG. 5 is a flowchart conceptually showing a series of steps in the production method for the copper-based alloy material of the present invention.

In the copper-based alloy material of the present invention, as production conditions for obtaining a superelastic alloy material or a shape-memory alloy material which achieves the stably satisfactory superelasticity and which is excellent in repeated deformation resistance as described above, production steps as described below can be mentioned. An example of a typical production process is shown in FIG. 5.

(Step of Melting and Casting [Step 1])

The step 1 is a step of melting and casting the raw materials of the copper-based alloy material having the composition described above, and is preferably performed by an ordinary method.

(Step [Step 2] of Performing Hot Working)

The step 2 is a step of performing, after the step 1, the hot working such as hot rolling or hot forging, and is preferably performed by an ordinary method. For example, a temperature at which the hot working is performed preferably falls within a temperature range of 680 to 950° C., and the hot working is normally performed at about 800° C. When the hot working is performed at a temperature equal to or greater than 680° C., deformation resistance is decreased, and thus the working can be performed. On the other hand, the temperature range is set as described above because when the hot working is performed at a temperature exceeding 950° C., the copper-based alloy material may be melted.

(Step [Step 3] of Performing Intermediate Annealing)

The step 3 is a step of performing, after the step 2 (after the step 4 when repeated two or more times), the intermediate annealing in a first temperature range of 400 to 680° C. and preferably 400 to 550° C. The first temperature range is set as described above because when the intermediate annealing is performed at a heat treatment temperature higher than 680° C., the ratio of the β phase is excessively increased, and thus it is difficult to perform the cold working which is subsequently performed. On the other hand, the first temperature range is set as described above because when the intermediate annealing is performed at a heat treatment temperature lower than 400° C., the effect of hardening the structure as in aging treatment is increased, and thus it is difficult to perform the cold working. The time of the intermediate annealing preferably falls within a range of, for example, 1 to 120 minutes.

(Step [Step 4] of Performing Cold Working)

The step 4 is a step of performing, after the step 3, the cold working of cold rolling or cold wire drawing, and the cold working is performed such that a working rate is equal to or greater than 30%. In the entire production steps, in particular, the heat treatment temperature in the intermediate annealing [step 3] is set within the range of 400 to 680° C., a cold rolling rate or the working rate of cold wire drawing in the cold working (specifically, cold rolling or cold wire drawing) [step 4] is set within a range equal to or greater than 30% and thus it is possible to obtain the Cu—Al—Mn—Ni-based alloy material which achieves stably satisfactory superelasticity. Each of the intermediate annealing [step 3] and the cold working [step 4] is performed at least one or more times in this order, and thus the crystal orientation can be more preferably accumulated. The number of times the intermediate annealing [step 3] and the cold working [step 4] are repeated may be one, preferably two or more and more preferably three or more. This is because as the number of times the intermediate annealing [step 3] and the cold working [step 4] are repeated is increased, the orientation of a working aggregate structure proceeds to enhance the characteristics.

Here, the working rate is a value which is defined by a formula below.

$$\text{working rate (\%)}=\{(A_1-A_2)/A_1\}\times 100$$

$A_1$ is the cross-sectional area ($mm^2$) of the specimen before the cold working (cold rolling or cold wire drawing), and $A_2$ is the cross-sectional area ($mm^2$) of the specimen after the cold working.

A cumulative working rate in the cold working [step 4] when each of the intermediate annealing [step 3] and the cold working [step 4] is performed two or more times is preferably equal to or greater than 30% and more preferably equal to or greater than 45%. Although the upper limit value of the cumulative working rate is not particularly limited, the upper limit value is normally equal to or less than 95%.

(Step [Step 5] of Performing Additional Intermediate Annealing)

The step 5 is a step of further performing, after the step 4, the additional intermediate annealing in the second temperature range in order to stabilize a precipitation phase. The second temperature range is preferably set within a range of 400 to 550° C. When an annealing temperature is excessively lower than 400° C., the effect of precipitating a precipitation phase (NiAl) tends not to be sufficiently obtained whereas when the annealing temperature is higher than 550° C., the amount of α phase (fcc structure) precipitated in the matrix of the β phase is excessively increased, and thus the effect of enhancing the degree of order caused by the precipitation of a B2-type precipitation phase tends not to be sufficiently achieved. Although a heat treatment time in the additional intermediate annealing is not particularly limited, it is confirmed that when the heat treatment time is set to, for example, 1 to 120 minutes, the copper-based alloy material whose ordered structure is not disturbed in the subsequent step is obtained. Although the detailed cause of the stabilization of the ordered structure in this step is not clarified, it is estimated that the cause is the effect of precipitation caused by a fine Ni-based substance.

(Step [Step 6] of Performing Heating to Third Temperature Range and Holding Third Temperature Range)

The step 6 is a step of performing heating from room temperature (20° C.±20° C.) to the third temperature range of 400 to 650° C. and holding the third temperature range, and is a step for fixing (controlling) the amount of α phase precipitated. The third temperature range is conceptually a temperature range in which the (α+β) phase is formed, and specifically, though the third temperature range is different depending on the alloy composition, the third temperature range is a temperature range of 400 to 650° C. and preferably 450 to 550° C. The temperature range is set as described above because when a heating temperature is less than 400° C., the cold working cannot be disadvantageously performed whereas when the heating temperature is higher than 650° C., the aggregate structure is disadvantageously random. As described above, after the step [step 6] of temporarily performing heating to and holding the third temperature range in which the (α+β) phase is formed, the step [step 7] of performing heating to and holding the fourth temperature range in which the β single phase is formed is performed, and thus the α phase can be made to disappear, with the result that the effect of increasing the size of the crystal grains is easily obtained by the thermal treatment (crystal grain coarsening treatment (steps 8 to 10) which is subsequently performed. Although a holding time in the heat treatment of the step 6 is not particularly limited, the holding time is preferably set to, for example, 1 to 120 minutes. When in the step 6, the heating from room temperature to the third temperature range is performed, as long as the temperature can be increased to the third temperature range in which the (α+β) phase is formed, the rate of temperature increase here is not particularly limited, and the rate of temperature increase is preferably equal to or greater than, for example, 0.1° C./minute. However, when it is necessary to reduce the entire time for the production, the rate of temperature increase is preferably equal to or greater than 20° C./minute which is a high rate.

(Step [Step 7] of Performing Heating to Fourth Temperature Range and Holding Fourth Temperature Range)

The step 7 is a step of further performing heating from the third temperature range to the fourth temperature range of 700 to 950° C. and holding the fourth temperature range. The fourth temperature range is conceptually a temperature range in which the β single phase is formed, and specifically, though the fourth temperature range is different depending on the alloy composition, the fourth temperature range is a temperature range of 700 to 950° C., preferably 750° C. or more and further preferably 800 to 950° C. The temperature range is set as described above because when a heating temperature is less than 700° C., the α phase is disadvantageously left without completely disappearing whereas when the heating temperature is higher than 950° C., the copper-based alloy may be melted. Although a holding time in the fourth temperature range is not particularly limited, the holding time is preferably set within a range of, for example, 5 to 480 minutes. The rate of temperature increase at which the heating from the third temperature range to the fourth temperature range is performed is preferably controlled to be within a predetermined slow range so as to be 0.1 to 20° C./minute, preferably 0.1 to 10° C./minute and further preferably 0.1 to 3.3° C./minute. When the rate of temperature increase is faster than 20° C./minute, fine crystal grains are generated in the surface of the alloy material, and thus it is highly likely that the existence frequency P of crystal grain boundaries X described previously cannot be equal to or less than 0.2. Although the lower limit value of the rate of temperature increase is not particularly limited, the lower limit value is set to 0.1° C./minute with consideration given to the limit of industrial products.

(Step [Step 8] of Performing Cooling from Fourth Temperature Range to Third Temperature Range and Holding Third Temperature Range)

The step 8 is a step of performing cooling from the fourth temperature range to the third temperature range and holding the third temperature range. The rate of temperature decrease in the cooling from the fourth temperature range in which the β single phase is formed to the third temperature range in which the (α+β) phase is formed is preferably controlled to be within a predetermined slow range so as to be 0.1 to 20° C./minute, preferably 0.1 to 10° C./minute and further preferably 0.1 to 3.3° C./minute. When the rate of temperature decrease is faster than 20° C./minute, fine crystal grains are generated in the surface of the alloy material, and thus it is highly likely that the existence frequency P of crystal grain boundaries X described above cannot be equal to or less than 0.2. Although the lower limit value of the rate of temperature decrease is not particularly limited, the lower limit value is set to 0.1° C./minute with consideration given to the limit of industrial products. The third temperature range is normally 400 to 650° C. in which the α+β phase is formed, and preferably 450 to 550° C. When the third temperature range is higher than 650° C., the ratio of the β phase is excessively increased, and thus the pinning effect of the α phase is not sufficient, with the result that it is highly likely that it is impossible to obtain the crystal grain diameter that satisfies the condition in which the existence frequency P of crystal grain boundaries X described above is equal to or less than 0.2. On the other hand, when the third temperature range is lower than 400° C., the ratio of the α phase is excessively increased, and thus the pinning effect is excessively enhanced, with the result that it is highly likely that it is impossible to obtain the crystal grain diameter that satisfies the condition in which the existence frequency P of crystal grain boundaries X described above is equal to or less than 0.2. Furthermore, although a holding time for which the third temperature range is held is not particularly limited, the holding time is preferably set within a range of 2 to 480 minutes and more preferably set within a range of 30 to 360 minutes.

(Step [Step 9] of Performing Heating from Third Temperature Range to Fourth Temperature Range and Holding Fourth Temperature Range)

The step 9 is a step of performing heating from the third temperature range to the fourth temperature range and holding the fourth temperature range. Here, the rate of temperature increase at which the heating from the third temperature range to the fourth temperature range is performed is preferably controlled to be within a predetermined range so as to be 0.1 to 20° C./minute, preferably 1 to 10° C./minute and further preferably 2 to 5° C./minute. When the rate of temperature increase is faster than 20° C./minute, fine crystal grains are generated in the surface of the alloy material, and thus it is highly likely that the existence frequency P of crystal grain boundaries X described above cannot be equal to or less than 0.2. Although the lower limit value of the rate of temperature increase is not particularly limited, the lower limit value is set to 0.1° C./minute with consideration given to the limit of industrial products. The fourth temperature range is normally a temperature range in which the β single phase is formed, and specifically, though the fourth temperature range is different depending on the alloy composition, the fourth temperature range is a temperature range of 700 to 950° C., preferably 750° C. or more and further preferably 800 to 950° C. The temperature range is set as described above because when a heating temperature is less than 700° C., the α phase is disadvantageously left without completely disappearing whereas when the heating temperature is higher than 950° C., the copper-based alloy may be melted. Although a holding time in the fourth temperature range is not particularly limited, the holding time is preferably set within a range of, for example, 5 to 480 minutes and more preferably set within a range of 30 to 360 minutes.

The [step 8] and the [step 9] are preferably repeated at least two or more times, more preferably three or more times and further preferably four or more times, When the number of times the [step 8] and the [step 9] are repeated is less than two, driving power for increasing the size of crystal grains is not sufficient, with the result that it is highly likely that it is impossible to obtain the crystal grain diameter that satisfies the condition in which the existence frequency P of crystal grain boundaries X described above is equal to or less than 0.2.

(Step [Step 10] of Performing Quenching from Fourth Temperature Range)

The step 10 is a step of performing quenching from the fourth temperature range, and is specifically solution treatment by quenching (so-called hardening) which is performed after the step 8 and the step 9 described above are repeated at least two or more times. This quenching can be performed, for example, by putting the copper-based alloy material heated and held in the β single phase into cold water, that is, by water cooling. The rate of cooling at the time of quenching is equal to or greater than 30° C./second, preferably equal to or greater than 100° C./second and further preferably equal to or greater than 1000° C./second. When the rate of cooling is so slow as to be less than 30° C./second, the α phase is precipitated, and thus it is likely that the degree of order of the β phase cannot be kept in the subsequent step. The upper limit value of the rate of cooling depends on the physical property values of the copper-based alloy material, and thus it is virtually impossible to set the upper limit value.

Although the method for producing the copper-based alloy material according to the present invention has the steps 1 to 10 described above as a basic configuration, the method preferably further includes a step ([step 11]) of performing, after the step ([step 10]) of performing quenching, heating to a fifth temperature range of 80 to 300° C. and holding the fifth temperature range.

(Step [Step 11] of Performing, after Quenching, Heating to Fifth Temperature Range and Holding Fifth Temperature Range)

The method for producing the copper-based alloy material according to the present invention preferably further includes the step ([step 11]) of performing, after the step ([step 10]) of performing quenching, heating to the fifth temperature range of 80 to 300° C. and holding the fifth temperature range. The step 11 is so-called aging heat treatment which is performed after quenching. The step 11 is further performed, and thus the β phase forming the matrix can be made to have an $L2_1$-type crystal structure, with the result that the superelasticity, the fatigue resistance and the fracture resistance can be significantly enhanced. The fifth temperature range can be a temperature range of 80 to 300° C. and preferably 150 to 250° C. When the heat treatment temperature described above is less than 80° C., the β phase is not stable depending on the alloy composition, and thus when the copper-based alloy material is left to stand at room temperature, a martensitic transformation temperature may be changed. When the heat treatment temperature is equal to or greater than 200° C., by long-term aging heat treatment, a bainite phase which increases hysteresis to lower ductility is precipitated but when the heat treatment temperature is up to 300° C., the amount of bainite phase precipitated is less than 80%, and thus there is no significant problem on the superelasticity and the ductility. On the other hand, when the heat treatment temperature is higher than 300° C., the bainite phase is excessively precipitated to lower the ductility, and thus the α phase is easily precipitated, with the result that it is likely that it is impossible to obtain a two-phase structure of the matrix of the β phase and the B2-type precipitation phase. In addition, the precipitation of the α phase is not preferable because the shape memory characteristics and the superelasticity tend to be significantly lowered. Although a holding time in the fifth temperature range is not particularly limited, the holding time is preferably set within a range of, for example, 5 to 120 minutes.

<Applications of Copper-Based Alloy Material>

The copper-based alloy material of the present invention can be suitably used for members which are intended for vibration damping attenuation on vibration, members which are intended for suppression or attenuation of noise and members which are intended for self-restoration (self-centering). These members are formed from a bar material and a plate material. Although examples of a vibration damping (seismic vibration damping) material and a building material are not particularly limited, the examples include a brace, a fastener, an anchor bolt and the like. Furthermore, in particular, the copper-based alloy material can be used, even in fields in which the copper-based alloy material is difficult to conventionally use, for space equipment, aviation equipment, automobile members, building members, electronic parts, medical products and the like in which repeated deformation resistance is needed. By utilization of the characteristic of absorbing vibration, the copper-based alloy material can also be utilized as civil engineering/building materials with which public nuisances of noise and vibration can be prevented. Furthermore, when the copper-based alloy material is intended for the effect of attenuating noise, the copper-based alloy material can also be applied to the field of transportation devices. In any case, excellent self-restoration is provided, and thus the copper-based alloy material can also be used as a self-restoring material. Moreover, since the crystal structure which includes a large amount of Heusler alloy-specific $L2_1$-type ordered structure is provided, excellent magnetic characteristics are provided, and thus it can be expected that the copper-based alloy material is utilized for new applications such as a magnetic actuator and a magnetic sensor. The copper-based alloy material of the present invention can be suitably used as a vibration damping (seismic vibration damping) structure. The vibration damping (seismic vibration damping) structure is constructed with a vibration damping (seismic vibration damping) material. Examples of the vibration damping (seismic vibration damping) structure are not particularly limited, and the copper-based alloy material may be used as any structure as long as the structure is a structure formed from the brace, the fastener, the anchor bolt or the like described above. The copper-based alloy material of the present invention can also be utilized as civil engineering/building materials with which public nuisances of noise and vibration can be prevented. For example, a composite material is formed from the copper-based alloy material together with concrete so as to be able to be used. The copper-based alloy material of the present invention can also be used as vibration absorbing members and self-restoring materials in space equipment, aircraft, automobiles and like. The copper-based alloy material can also be applied to the field of transportation devices which are intended for the effect of attenuating noise. Excellent magnetic characteristics are provided, and thus the copper-based alloy material can also be applied to fields of a magnetic actuator, a magnetic sensor and the like in which magnetism is utilized.

The embodiment described above is illustrated for ease of understanding of the specific aspect of this invention, and this invention is not limited to only the embodiment described above and is widely interpreted without departing from the spirit and scope of the invention in the scope of claims.

EXAMPLES

Although the present invention will be described in further detail below based on Examples, the present invention is not limited to only Examples.

Examples 1 to 60 and Comparative Examples 1 to 47

Samples (test materials) of a bar material (wire material) were made under conditions below. As the raw materials of copper-based alloy materials providing compositions shown in table 1, the raw materials of pure copper, pure Mn, pure Al, pure Ni and other sub-additive elements as necessary were melted in a high-frequency induction furnace in the atmosphere, were thereafter cooled and cast with a predetermined sized mold, with the result that an ingot having an outer diameter of 80 mm and a length of 300 mm was obtained ([step 1]). Then, the obtained ingot was subjected to hot working or extrusion at 800° C. ([step 2]). Thereafter, under conditions shown in table 2, the steps of [step 3] to [step 9] were performed, then quenching was performed ([step 10]) and thereafter in processes except six processes (process Nos. ad, ae, af, W, X and Y), aging heat treatment was further performed, with the result that the bar material of JIS No. 2 test piece (diameter $d_o$: 16 mm, total length Lt: 300 mm, parallel portion length Lc: 250 mm) was made. With respect to the other production conditions which are not shown in table 2, in all Examples and Comparative Examples, the same production conditions described below were used.

<Same Production Conditions>

[Step 3] An intermediate annealing time was 100 minutes.

[Step 5] An additional intermediate annealing time was 30 minutes.

[Step 6] The rate of temperature increase from room temperature to an (α+β) region was 30° C./minute, and a holding time in the (α+β) region was 60 minutes.

[Step 7] A holding time in a β single-phase region was 120 minutes.

[Step 8] A holding time in the (α+β) region was 60 minutes.

[Step 9] A holding time in the β single-phase region was 120 minutes.

[Step 10] The rate of quenching from the R single-phase region was 50° C./second.

[Step 11] An aging heat treatment time was 20 minutes.

(Evaluation Methods)

Tests and evaluation methods will be described in detail below.

(1) Identification of Crystal Structure of Metal Structure of Copper-Based Alloy Material For the crystal structure of the metal structure of the copper-based alloy material, a matrix and a precipitation phase were identified with an electron diffraction pattern and a dark-field image obtained with a TEM.

(2) Method of Calculating Existence Frequency P of Crystal Grain Boundaries X in Copper-Based Alloy Material A test piece (specimen) of a tensile test for evaluation of repeated deformation resistance (fatigue resistance and fracture resistance) described later was used, the surface of the test piece was etched with a ferric chloride aqueous solution before the tensile test and thus the crystal grain boundary X of the copper-based alloy material was observed on the surface (to be exact, the semi-circumferential surface 9) of the copper-based alloy material. Although the upper limit of the total length of the test piece to be observed was not particularly determined, the upper limit was assumed to be a length equal to or greater than the original gauge distance $L_o$ of the tensile test described later. Hence, in the present invention, crystal grain boundaries were observed on the surfaces (semi-circumferential surfaces 9) of 20 test pieces (N=20) having a total length of 250 mm, then the number of crystal grain boundaries X in the original gauge distance $L_o$=300 mm was counted, the numbers n1, n2, . . . , n19 and n20 of crystal grain boundaries existing on the 20 test pieces were added together and thus the total number n (=n1+n2+ . . . +n20) was calculated, with the result that the existence frequency P which was a ratio n/N obtained by dividing the total number n by the number N (=20) of test pieces was calculated. The existence frequencies P of crystal grain boundaries are shown in tables 3 and 4.

(3) Fatigue Resistance

With respect to the fatigue resistance, 5 out of the 20 test pieces used for calculating the existence frequency of crystal grain boundaries in (2) described above were used, loading and unloading of a stress applying a 5% strain was repeated to produce a stress-strain curve (SS curve), a residual strain (%) after 1000 cycles were repeated was determined from the stress-strain curve (see FIG. 3) and the fatigue resistance was evaluated with the value of the residual strain. As the value of the residual strain is decreased, more excellent fatigue resistance is provided. As test conditions, the original gauge distance was 200 mm, the tensile test for alternately repeating the loading and unloading of the stress applying a 5% strain was performed 1000 times at a test speed of 5%/minute, the fatigue resistance was evaluated based on three-stage criteria below and in the present invention, when the evaluations were "1" and "2", the fatigue resistance was evaluated to be an acceptance level. The results of the evaluations of the fatigue resistance are shown in tables 3 and 4.

<Evaluation Criteria of Fatigue Resistance>

1 (excellent): case where the residual strain was equal to or less than 1.4%

2 (good): case where the residual strain was greater than 1.4% and equal to or less than 2.0%

3 (poor): case where the residual strain was greater than 2.0% or case where a fracture occurred before the number of times repeated reached 1000

(4) Fracture Resistance

With respect to the fracture resistance, 5 out of the 20 test pieces used for calculating the existence frequency of crystal grain boundaries in (2) described above were used, loading and unloading of a stress applying a 3% strain was performed and the number of times the loading and unloading was repeated until the occurrence of a fracture was determined (See FIG. 4). As the number of times the loading and unloading is repeated until the occurrence of a fracture is increased, repeated deformation is withstood, thus it is possible to reduce the collapse of a building or the destruction of a member, with the result that excellent fracture resistance is provided. As test conditions, the original gauge distance was 200 mm, the tensile test for alternately repeating the loading and unloading of the stress applying a 3% strain was performed 1000 times at a test speed of 3%/minute, the fracture resistance was evaluated based on three-stage criteria below and in the present invention, when the evaluations were "1" and "2", the fracture resistance was evaluated to be an acceptance level. The results of the evaluations of the fracture resistance are shown in tables 3 and 4.

<Evaluation Criteria of Fracture Resistance>

1 (excellent): case where in all the 5 test pieces, the number of times repeated reached a measurement upper limit of 5000

2 (good): case where in all the 5 test pieces, the number of times repeated was equal to or greater than 1000 but the number of times repeated in at least one test piece did not reach 5000

3 (poor): case where among the 5 test pieces, the number of times repeated in at least one test piece did not reach 1000

(5) Comprehensive Evaluation of Repeated Deformation Resistance

For the repeated deformation resistance, based on the evaluation results of both the fatigue resistance and the fracture resistance, a comprehensive evaluation was performed based on criteria as described below. In the present invention, when the comprehensive evaluations were "A", "B" and "C", the repeated deformation resistance was evaluated to be an acceptance level. The results of the comprehensive evaluations of the repeated deformation resistance are shown in tables 3 and 4.

<Comprehensive Evaluation Criteria of Repeated Deformation Resistance>

A: case where the evaluation of the fatigue resistance was "1" and the evaluation of the fracture resistance was "1" or "2"

B: case where the evaluation of the fatigue resistance was "2" and the evaluation of the fracture resistance was "1" or "2"

C: case where the evaluation of the fatigue resistance was "1" or "2" and the evaluation of the fracture resistance was "3"

D: case where the evaluation of the fatigue resistance was "3"

TABLE 1-1

| Alloy | Chemical compssition (mass %) | | | | | | | | | | | | | | | | | |
|---|---|---|---|---|---|---|---|---|---|---|---|---|---|---|---|---|---|---|
| No. | Al | Mn | Ni | Co | Fe | Ti | V | Nb | Ta | Zr | Cr | Mo | W | Ce | Si | C | B | Cu |
| 1 | 10.0 | 7.0 | 4.8 | — | — | — | — | — | — | — | — | — | — | — | — | — | — | Balance |
| 2 | 8.6 | 7.0 | 4.8 | — | — | — | — | — | — | — | — | — | — | — | — | — | — | Balance |
| 3 | 12.6 | 7.0 | 4.8 | — | — | — | — | — | — | — | — | — | — | — | — | — | — | Balance |
| 4 | 10.0 | 2.9 | 4.8 | — | — | — | — | — | — | — | — | — | — | — | — | — | — | Balance |
| 5 | 10.0 | 8.9 | 4.8 | — | — | — | — | — | — | — | — | — | — | — | — | — | — | Balance |
| 6 | 9.7 | 6.9 | 5.3 | — | — | — | — | — | — | — | — | — | — | — | — | — | — | Balance |
| 7 | 9.8 | 7.0 | 3.2 | — | — | — | — | — | — | — | — | — | — | — | — | — | — | Balance |
| 8 | 9.8 | 7.0 | 10.0 | — | — | — | — | — | — | — | — | — | — | — | — | — | — | Balance |
| 9 | 10.3 | 6.0 | 6.4 | — | — | — | — | — | — | — | — | — | — | — | — | — | — | Balance |
| 10 | 10.0 | 7.0 | 4.8 | 1.80 | — | — | — | — | — | — | — | — | — | — | — | — | — | Balance |
| 11 | 10.0 | 7.0 | 4.8 | — | 2.90 | — | — | — | — | — | — | — | — | — | — | — | — | Balance |
| 12 | 10.0 | 7.0 | 4.8 | — | — | 1.80 | — | — | — | — | — | — | — | — | — | — | — | Balance |
| 13 | 10.0 | 7.0 | 4.8 | — | — | — | 1.03 | — | — | — | — | — | — | — | — | — | — | Balance |
| 14 | 10.0 | 7.0 | 4.8 | — | — | — | — | 0.80 | — | — | — | — | — | — | — | — | — | Balance |
| 15 | 10.0 | 7.0 | 4.8 | — | — | — | — | — | 0.80 | — | — | — | — | — | — | — | — | Balance |
| 16 | 10.0 | 7.0 | 4.8 | — | — | — | — | — | — | 0.90 | — | — | — | — | — | — | — | Balance |
| 17 | 10.0 | 7.0 | 4.8 | — | — | — | — | — | — | — | 1.80 | — | — | — | — | — | — | Balance |
| 18 | 10.0 | 7.0 | 4.8 | — | — | — | — | — | — | — | — | 1.00 | — | — | — | — | — | Balance |
| 19 | 10.0 | 7.0 | 4.8 | — | — | — | — | — | — | — | — | — | 1.03 | — | — | — | — | Balance |
| 20 | 10.0 | 7.0 | 4.8 | — | — | — | — | — | — | — | — | — | — | 0.48 | — | — | — | Balance |
| 21 | 10.0 | 7.0 | 4.8 | — | — | — | — | — | — | — | — | — | — | — | 1.90 | — | — | Balance |
| 22 | 10.0 | 7.0 | 4.8 | — | — | — | — | — | — | — | — | — | — | — | — | 0.48 | — | Balance |
| 23 | 10.0 | 7.0 | 4.8 | 1.00 | 1.20 | 0.50 | 0.23 | 0.20 | 0.20 | 0.20 | 1.00 | 0.20 | 0.23 | 0.20 | 0.50 | 0.01 | — | Balance |
| 24 | 10.0 | 7.0 | 4.8 | 2.00 | — | 2.00 | — | — | — | — | 2.00 | — | 1.03 | — | 2.00 | — | — | Balance |
| 25 | 10.0 | 7.0 | 4.8 | — | 3.00 | 2.00 | — | — | — | — | 2.00 | — | 1.03 | — | 2.00 | — | — | Balance |

(Note)
Symbol "—" in the table indicates that the corresponding element was not added as an ingredient of raw material.

TABLE 1-2

| Alloy | Chemical composition (mass %) | | | | | | | | | | | | | | | | | |
|---|---|---|---|---|---|---|---|---|---|---|---|---|---|---|---|---|---|---|
| No. | Al | Mn | Ni | Co | Fe | Ti | V | Nb | Ta | Zr | Cr | Mo | W | Ce | Si | C | B | Cu |
| 26 | 10.0 | 7.0 | 4.8 | 1.80 | — | — | 0.50 | — | — | — | — | — | 0.50 | — | — | — | — | Balance |
| 27 | 10.0 | 7.0 | 4.8 | — | 2.83 | — | 0.50 | — | — | — | — | — | 0.50 | — | — | — | — | Balance |
| 28 | 8.2 | 11.2 | — | — | — | — | — | — | — | — | — | — | — | — | — | — | — | Balance |
| 29 | 7.8 | 12.4 | — | — | — | — | — | — | — | — | — | — | — | — | — | — | — | Balance |
| 30 | 9.8 | 8.0 | — | — | — | — | — | — | — | — | — | — | — | — | — | — | — | Balance |
| 31 | 3.0 | 11.0 | — | — | — | — | — | — | — | — | — | — | — | — | — | — | — | Balance |
| 32 | 10.0 | 10.8 | — | — | — | — | — | — | — | — | — | — | — | — | — | — | — | Balance |
| 33 | 8.0 | 5.0 | — | — | — | — | — | — | — | — | — | — | — | — | — | — | — | Balance |
| 34 | 8.0 | 19.8 | — | — | — | — | — | — | — | — | — | — | — | — | — | — | — | Balance |
| 35 | 10.0 | 6.2 | — | — | — | — | — | — | — | — | — | — | — | — | — | — | — | Balance |
| 36 | 9.5 | 6.9 | — | — | — | — | — | — | — | — | — | — | — | — | — | — | — | Balance |
| 37 | 9.0 | 7.3 | — | — | — | — | — | — | — | — | — | — | — | — | — | — | — | Balance |
| 38 | 8.6 | 8.0 | — | — | — | — | — | — | — | — | — | — | — | — | — | — | — | Balance |
| 39 | 7.9 | 9.1 | — | — | — | — | — | — | — | — | — | — | — | — | — | — | — | Balance |
| 40 | 7.5 | 9.9 | — | — | — | — | — | — | — | — | — | — | — | — | — | — | — | Balance |
| 41 | 7.6 | 8.9 | 2.0 | — | — | — | — | — | — | — | — | — | — | — | — | — | — | Balance |
| 42 | 10.0 | 10.8 | — | — | — | — | 1.00 | — | — | — | — | — | — | — | — | — | — | Balance |
| 43 | 8.0 | 5.0 | — | — | — | 0.50 | — | — | — | — | — | — | — | — | — | — | 0.02 | Balance |
| 44 | 10.0 | 2.7 | 4.8 | — | — | — | — | — | — | — | — | — | — | — | — | — | — | Balance |
| 45 | 10.0 | 9.2 | 4.8 | — | — | — | — | — | — | — | — | — | — | — | — | — | — | Balance |
| 46 | 8.5 | 7.0 | 4.8 | — | — | — | — | — | — | — | — | — | — | — | — | — | — | Balance |
| 47 | 12.8 | 7.0 | 4.8 | — | — | — | — | — | — | — | — | — | — | — | — | — | — | Balance |
| 48 | 10.0 | 7.0 | 3.0 | — | — | — | — | — | — | — | — | — | — | — | — | — | — | Balance |
| 49 | 10.0 | 7.0 | 10.5 | — | — | — | — | — | — | — | — | — | — | — | — | — | — | Balance |

(Note)
Symbol "—" in the table indicates that the corresponding element was not added as an ingredient of raw material.

TABLE 2-1

| Process No. | Step 3 Intermediate annealing temperature (° c.) | Step 4 Cold working rate (%) | Number of times steps 3 and 4 were repeated (times) | Cumulative working rate in step 4 (%) | Step 5 Intermediate annealing temperature (° c.) | Step 6 Holding temperature in (α + β) region (° c.) | Step 7 Rate of temperature increase (° c./min.) | Step 7 Holding temperature in β single phase region (° c.) | Step 8 Rate of temperature decrease (° c./min.) | Step 8 Holding temperature in (α + β) region (° c.) | Step 9 Rate of temperature increase (° c./min.) | Step 9 Holding temperature in β single phase region (° c.) | Number of times steps 8 and 9 were repeated (times) | Step 11 Aging treatment temperature (° c.) |
|---|---|---|---|---|---|---|---|---|---|---|---|---|---|---|
| a | 550 | 30 | 3 | 65 | 400 | 450 | 1 | 900 | 1 | 450 | 1 | 900 | 4 | 200 |
| b | 550 | 30 | 3 | 65 | 500 | 500 | 1 | 900 | 1 | 500 | 1 | 900 | 4 | 200 |
| c | 550 | 30 | 3 | 65 | 550 | 600 | 1 | 900 | 1 | 600 | 1 | 900 | 4 | 200 |
| d | 450 | 30 | 3 | 65 | 400 | 450 | 1 | 900 | 1 | 450 | 1 | 900 | 4 | 200 |
| e | 450 | 30 | 3 | 65 | 500 | 500 | 1 | 900 | 1 | 500 | 1 | 900 | 4 | 200 |
| f | 600 | 30 | 3 | 65 | 400 | 450 | 1 | 900 | 1 | 450 | 1 | 900 | 4 | 200 |
| g | 600 | 30 | 3 | 65 | 500 | 500 | 1 | 900 | 1 | 500 | 1 | 900 | 4 | 200 |
| h | 600 | 30 | 3 | 65 | 550 | 600 | 1 | 900 | 1 | 600 | 1 | 900 | 4 | 200 |
| i | 550 | 30 | 3 | 65 | 480 | 550 | 11 | 900 | 1 | 550 | 11 | 900 | 4 | 150 |
| j | 550 | 30 | 3 | 65 | 480 | 600 | 1 | 900 | 11 | 600 | 1 | 900 | 4 | 150 |
| k | 550 | 30 | 3 | 65 | 480 | 500 | 20 | 900 | 1 | 500 | 20 | 900 | 4 | 200 |
| l | 550 | 30 | 3 | 65 | 480 | 550 | 1 | 900 | 20 | 550 | 1 | 900 | 4 | 150 |
| m | 550 | 30 | 3 | 65 | 480 | 420 | 20 | 900 | 20 | 500 | 20 | 900 | 4 | 150 |
| n | 550 | 35 | 1 | 35 | 550 | 550 | 1 | 900 | 1 | 550 | 1 | 900 | 4 | 200 |
| o | 450 | 30 | 3 | 65 | 450 | 400 | 1 | 900 | 1 | 400 | 1 | 900 | 4 | 230 |
| p | 650 | 30 | 3 | 65 | 450 | 650 | 1 | 900 | 1 | 650 | 1 | 900 | 4 | 230 |
| q | 450 | 30 | 3 | 65 | 550 | 400 | 11 | 900 | 1 | 400 | 11 | 900 | 4 | 230 |
| r | 650 | 30 | 3 | 65 | 550 | 650 | 11 | 900 | 1 | 400 | 11 | 900 | 4 | 200 |
| s | 450 | 30 | 3 | 65 | 550 | 500 | 1 | 900 | 11 | 550 | 1 | 900 | 4 | 200 |
| t | 650 | 30 | 3 | 65 | 550 | 500 | 1 | 900 | 11 | 500 | 1 | 900 | 4 | 200 |
| u | 450 | 35 | 1 | 35 | 500 | 550 | 1 | 900 | 1 | 550 | 1 | 900 | 4 | 180 |
| v | 650 | 30 | 1 | 35 | 500 | 450 | 1 | 900 | 1 | 450 | 1 | 900 | 4 | 150 |
| w | 450 | 30 | 3 | 65 | 450 | 480 | 20 | 900 | 20 | 480 | 20 | 900 | 5 | 150 |
| x | 650 | 30 | 3 | 65 | 450 | 480 | 20 | 900 | 20 | 500 | 20 | 900 | 5 | 250 |
| y | 450 | 30 | 3 | 65 | 450 | 500 | 1 | 900 | 1 | 480 | 1 | 900 | 5 | 180 |
| z | 650 | 30 | 3 | 65 | 450 | 520 | 1 | 900 | 1 | 520 | 1 | 900 | 10 | 220 |
| aa | 550 | 30 | 3 | 65 | 400 | 450 | 1 | 900 | 1 | 450 | 1 | 900 | 2 | 200 |
| ab | 550 | 30 | 3 | 65 | 500 | 500 | 1 | 900 | 1 | 500 | 1 | 900 | 2 | 200 |
| ac | 550 | 30 | 3 | 65 | 550 | 600 | 1 | 900 | 1 | 600 | 1 | 900 | 3 | 200 |
| ad | 550 | 30 | 3 | 65 | 500 | 500 | 1 | 900 | 1 | 500 | 1 | 900 | 4 | 80 |

(Note)
"—" in the table indicates that the corresponding step was not performed.

TABLE 2-2

| Process No. | Step 3 Intermediate annealing temperature (° c.) | Step 4 Cold working rate (%) | Number of times steps 3 and 4 were repeated (times) | Cumulative working rate in step 4 (%) | Step 5 Intermediate annealing temperature (° c.) | Step 6 Holding temperature in (α + β) region (° c.) | Step 7 Rate of temperature increase (° c./min.) | Step 7 Holding temperature in β single phase region (° c.) | Step 8 Rate of temperature decrease (° c./min.) | Step 8 Holding temperature in (α + β) region (° c.) | Step 9 Rate of temperature increase (° c./min.) | Step 9 Holding temperature in β single phase region (° c.) | Number of times steps 8 and 9 were repeated (times) | Step 11 Aging treatment temperature (° c.) |
|---|---|---|---|---|---|---|---|---|---|---|---|---|---|---|
| aa | 550 | 30 | 3 | 65 | 500 | 500 | 1 | 900 | 1 | 500 | 1 | 900 | 4 | 300 |
| af | 550 | 30 | 3 | 65 | 400 | 400 | 1 | 900 | 1 | 400 | 1 | 900 | 4 | — |
| ag | 550 | 30 | 3 | 65 | 500 | 500 | 1 | 900 | 1 | 500 | 1 | 900 | 4 | — |
| ah | 550 | 30 | 3 | 65 | 550 | 650 | 1 | 900 | 1 | 650 | 1 | 900 | 4 | — |
| A | 550 | 30 | 3 | 65 | — | 450 | 1 | 900 | 1 | 450 | 1 | 900 | 3 | 200 |
| B | 480 | 35 | 3 | 73 | — | 300 | 1 | 900 | 1 | 300 | 1 | 900 | 2 | 150 |
| C | 550 | 35 | 3 | 73 | — | 500 | 1 | 900 | 1 | 500 | 1 | 900 | 3 | 150 |
| D | 500 | 35 | 3 | 73 | — | 700 | 1 | 900 | 1 | 390 | 1 | 900 | 2 | 180 |
| E | 520 | 35 | 3 | 73 | — | 680 | 1 | 900 | 1 | 680 | 1 | 900 | 2 | 180 |
| F | 500 | 35 | 3 | 73 | — | 700 | 1 | 900 | 1 | 390 | 1 | 900 | 3 | 180 |
| G | 520 | 35 | 3 | 73 | — | 680 | 1 | 900 | 1 | 680 | 1 | 900 | 3 | 180 |
| H | 520 | 35 | 3 | 73 | — | 550 | 1 | 900 | 1 | 550 | 1 | 900 | 2 | 180 |
| I | 550 | 30 | 3 | 65 | — | 350 | 1 | 900 | 1 | 350 | 1 | 900 | 1 | 150 |
| J | 450 | 30 | 3 | 65 | — | 350 | 1 | 900 | 1 | 350 | 1 | 900 | 1 | 180 |
| K | 650 | 30 | 3 | 65 | — | 350 | 1 | 900 | 1 | 350 | 1 | 900 | 1 | 180 |
| L | 550 | 30 | 3 | 65 | — | — | 1 | 900 | 1 | 550 | 1 | 900 | 2 | 150 |
| M | 550 | 30 | 3 | 65 | — | 450 | 1 | 900 | 1 | 450 | 1 | 900 | 4 | 200 |
| N | 550 | 30 | 3 | 65 | — | 500 | 1 | 900 | 1 | 500 | 1 | 900 | 4 | 180 |
| O | 550 | 30 | 3 | 65 | — | 550 | 11 | 900 | 1 | 550 | 11 | 900 | 4 | 150 |
| P | 550 | 30 | 3 | 65 | — | 600 | 1 | 900 | 11 | 600 | 1 | 900 | 4 | 150 |
| Q | 550 | 30 | 3 | 65 | 380 | 450 | 1 | 900 | 1 | 450 | 1 | 900 | 4 | 200 |
| R | 550 | 30 | 3 | 65 | 380 | 500 | 1 | 900 | 1 | 500 | 1 | 900 | 4 | 200 |
| S | 550 | 30 | 3 | 65 | 380 | 600 | 1 | 900 | 1 | 600 | 1 | 900 | 4 | 200 |
| T | 550 | 30 | 3 | 65 | 570 | 450 | 1 | 900 | 1 | 450 | 1 | 900 | 4 | 200 |
| U | 550 | 30 | 3 | 65 | 570 | 500 | 1 | 900 | 1 | 500 | 1 | 900 | 4 | 200 |
| V | 550 | 30 | 3 | 65 | 570 | 600 | 1 | 900 | 1 | 600 | 1 | 900 | 4 | 200 |
| W | 550 | 30 | 3 | 65 | — | 450 | 1 | 900 | 1 | 450 | 1 | 900 | 4 | — |
| X | 550 | 30 | 3 | 65 | — | 500 | 1 | 900 | 1 | 500 | 1 | 900 | 4 | — |
| Y | 550 | 30 | 3 | 65 | — | 600 | 1 | 900 | 1 | 600 | 1 | 900 | 4 | — |

(Note)
"—" in the table indicates that the corresponding step was not performed.

TABLE 3-1

| | | | Structure | | | Characteristic evaluation | | | | | |
|---|---|---|---|---|---|---|---|---|---|---|---|
| | | | Crystal structure | | Existence frequency P of crystal grain boundaries (N = 20) | Fracture resistance: Number of times repeated | | | Fatigue resistance | | |
| | Alloy No. | Process No. | Matrix (Parent phase) | Precipitation phase | | Maximum (times) | Minimum (times) | Evaluation | Residual strain (%) | Evaluation | Comprehensive evaluation |
| Example 1 | 1 | a | $L2_1$ | B2 | 0.05 | 5000 | / | 1 | 0.2 | 1 | A |
| Example 2 | 1 | b | $L2_1$ | B2 | 0.05 | 5000 | / | 1 | 0.2 | 1 | A |
| Example 3 | 1 | c | $L2_1$ | B2 | 0.00 | 5000 | / | 1 | 0.2 | 1 | A |
| Example 4 | 1 | d | $L2_1$ | B2 | 0.05 | 5000 | / | 1 | 0.3 | 1 | A |
| Example 5 | 1 | e | $L2_1$ | B2 | 0.05 | 5000 | / | 1 | 0.2 | 1 | A |
| Example 6 | 1 | f | $L2_1$ | B2 | 0.00 | 5000 | / | 1 | 0.3 | 1 | A |
| Example 7 | 1 | g | $L2_1$ | B2 | 0.00 | 5000 | / | 1 | 0.3 | 1 | A |
| Example 8 | 1 | h | $L2_1$ | B2 | 0.00 | 5000 | / | 1 | 0.2 | 1 | A |
| Example 9 | 1 | j | $L2_1$ | B2 | 0.05 | 5000 | / | 1 | 0.5 | 1 | A |
| Example 10 | 1 | i | $L2_1$ | B2 | 0.05 | 5000 | / | 1 | 0.5 | 1 | A |
| Example 11 | 1 | k | $L2_1$ | B2 | 0.15 | 5000 | / | 1 | 1.4 | 1 | A |
| Example 12 | 1 | l | $L2_1$ | B2 | 0.15 | 5000 | / | 1 | 1.2 | 1 | A |
| Example 13 | 1 | m | $L2_1$ | B2 | 0.20 | 5000 | 4412 | 2 | 1.7 | 2 | B |
| Example 14 | 1 | n | $L2_1$ | B2 | 0.10 | 5000 | / | 1 | 1.0 | 1 | A |
| Example 15 | 1 | o | $L2_1$ | B2 | 0.05 | 5000 | / | 1 | 0.5 | 1 | A |
| Example 16 | 1 | p | $L2_1$ | B2 | 0.15 | 5000 | / | 1 | 1.5 | 2 | B |
| Example 17 | 1 | q | $L2_1$ | B2 | 0.10 | 5000 | / | 1 | 1.0 | 1 | A |
| Example 18 | 1 | r | $L2_1$ | B2 | 0.05 | 5000 | / | 1 | 0.5 | 1 | A |
| Example 19 | 1 | s | $L2_1$ | B2 | 0.10 | 5000 | / | 1 | 1.0 | 1 | A |
| Example 20 | 1 | t | $L2_1$ | B2 | 0.10 | 5000 | / | 1 | 0.9 | 1 | A |
| Example 21 | 1 | u | $L2_1$ | B2 | 0.10 | 5000 | 4056 | 2 | 1.5 | 2 | B |
| Example 22 | 1 | v | $L2_1$ | B2 | 0.10 | 5000 | 3799 | 2 | 1.5 | 2 | B |
| Example 23 | 1 | w | $L2_1$ | B2 | 0.10 | 5000 | 3906 | 2 | 1.6 | 2 | B |
| Example 24 | 1 | x | $L2_1$ | B2 | 0.15 | 5000 | 3343 | 2 | 1.7 | 2 | B |
| Example 25 | 1 | y | $L2_1$ | B2 | 0.00 | 5000 | / | 1 | 0.4 | 1 | A |
| Example 26 | 1 | z | $L2_1$ | B2 | 0.00 | 5000 | / | 1 | 0.4 | 1 | A |
| Example 27 | 1 | aa | $L2_1$ | B2 | 2.00 | 3392 | 528 | 3 | 0.7 | 1 | C |
| Example 28 | 1 | ab | $L2_1$ | B2 | 1.85 | 3229 | 410 | 3 | 0.5 | 1 | C |
| Example 29 | 1 | ac | $L2_1$ | B2 | 1.75 | 4277 | 909 | 3 | 0.4 | 1 | C |
| Example 30 | 1 | ad | $L2_1$ | B2 | 0.00 | 5000 | / | 1 | 0.2 | 1 | A |

(Note)
Symbol "—" in the table indicates that the corresponding step was not performed, symbol "=" indicates that no precipitation phase was confirmed and symbol "/" indicates that all specimens were not fractured until 5000 times.

TABLE 3-2

| | | | Structure | | | Characteristic evaluation | | | | | |
|---|---|---|---|---|---|---|---|---|---|---|---|
| | | | Crystal structure | | Existence frequency P of crystal grain boundaries (N = 20) | Fracture resistance: Number of times repeated | | | Fatigue resistance | | |
| | Alloy No. | Process No. | Matrix (Parent phase) | Precipitation phase | | Maximum (times) | Minimum (times) | Evaluation | Residual strain (%) | Evaluation | Comprehensive evaluation |
| Example 31 | 1 | ae | $L2_1$ | B2 | 0.00 | 5000 | / | 1 | 0.2 | 1 | A |
| Example 32 | 1 | af | A2 | B2 | 0.05 | 5000 | / | 1 | 2.0 | 2 | B |
| Example 33 | 1 | ag | A2 | B2 | 0.05 | 5000 | / | 1 | 1.9 | 2 | B |
| Example 34 | 1 | ah | B2 | B2 | 0.05 | 5000 | 4803 | 2 | 1.8 | 2 | B |
| Example 35 | 2 | a | $L2_1$ | B2 | 0.15 | 5000 | / | 1 | 1.8 | 2 | B |
| Example 36 | 3 | a | $L2_1$ | B2 | 0.10 | 5000 | / | 1 | 0.8 | 1 | A |
| Example 37 | 4 | d | $L2_1$ | B2 | 0.05 | 5000 | / | 1 | 0.4 | 1 | A |
| Example 38 | 5 | g | B2 | B2 | 0.05 | 5000 | / | 1 | 1.7 | 2 | A |
| Example 39 | 6 | a | $L2_1$ | B2 | 0.00 | 5000 | / | 1 | 0.2 | 1 | A |
| Example 40 | 7 | a | $L2_1$ | B2 | 0.00 | 5000 | / | 1 | 0.2 | 1 | A |
| Example 41 | 8 | a | $L2_1$ | B2 | 0.10 | 5000 | / | 1 | 0.7 | 1 | A |
| Example 42 | 9 | a | $L2_1$ | B2 | 0.05 | 5000 | / | 1 | 0.2 | 1 | A |
| Example 43 | 10 | a | $L2_1$ | B2 | 0.05 | 5000 | / | 1 | 0.5 | 1 | A |
| Example 44 | 11 | d | $L2_1$ | B2 | 0.05 | 5000 | / | 1 | 0.4 | 1 | A |

TABLE 3-2-continued

| | | | Structure | | | Characteristic evaluation | | | | | |
|---|---|---|---|---|---|---|---|---|---|---|---|
| | | | | | Existence frequency P | Fracture resistance | | | Fatigue resistance | | |
| | | | Crystal structure | | of crystal | Number of times repeated | | | Residual | | |
| | Alloy No. | Process No. | Matrix (Parent phase) | Precipitation phase | grain boundaries (N = 20) | Maximum (times) | Minimum (times) | Evaluation | strain (%) | Evaluation | Comprehensive evaluation |
| Example 45 | 12 | a | $L2_1$ | B2 | 0.05 | 5000 | / | 1 | 0.4 | 1 | A |
| Example 46 | 13 | a | $L2_1$ | B2 | 0.10 | 5000 | / | 1 | 0.6 | 1 | A |
| Example 47 | 14 | a | $L2_1$ | B2 | 0.10 | 5000 | / | 1 | 0.7 | 1 | A |
| Example 49 | 15 | a | $L2_1$ | B2 | 0.10 | 5000 | / | 1 | 0.6 | 1 | A |
| Example 49 | 16 | a | $L2_1$ | B2 | 0.10 | 5000 | / | 1 | 0.6 | 1 | A |
| Example 50 | 17 | a | $L2_1$ | B2 | 0.10 | 5000 | 3814 | 1 | 0.2 | 1 | A |
| Example 51 | 18 | a | $L2_1$ | B2 | 0.10 | 5000 | 3876 | 2 | 0.7 | 1 | A |
| Example 52 | 19 | a | $L2_1$ | B2 | 0.10 | 5000 | 3799 | 2 | 0.9 | 1 | A |
| Example 53 | 20 | a | $L2_1$ | B2 | 0.10 | 5000 | 3845 | 2 | 0.9 | 1 | A |
| Example 54 | 21 | a | $L2_1$ | B2 | 0.15 | 5000 | 4429 | 2 | 0.9 | 1 | A |
| Example 55 | 22 | a | $L2_1$ | B2 | 0.10 | 5000 | 4898 | 2 | 0.6 | 1 | A |
| Example 56 | 25 | a | $L2_1$ | B2 | 0.20 | 4450 | 3844 | 2 | 1.9 | 2 | B |
| Example 57 | 24 | a | $L2_1$ | B2 | 0.15 | 5000 | 3965 | 2 | 1.6 | 2 | B |
| Example 58 | 25 | a | $L2_1$ | B2 | 0.15 | 4617 | 4009 | 2 | 1.5 | 2 | B |
| Example 59 | 26 | a | $L2_1$ | B2 | 0.15 | 5000 | / | 1 | 1.3 | 1 | A |
| Example 60 | 27 | a | $L2_1$ | B2 | 0.10 | 5000 | / | 1 | 1.0 | 1 | A |

(Note)
Symbol "—" in the table indicates that the corresponding step was not performed, symbol "=" indicates that no precipitation phase was confirmed and symbol "/" indicates that all specimens were not fractured until 5000 times.

TABLE 4-1

| | | | Structure | | | Characteristic evaluation | | | | | |
|---|---|---|---|---|---|---|---|---|---|---|---|
| | | | | | Existence frequency P | Fracture resistance | | | Fatigue resistance | | |
| | | | Crystal structure | | of crystal | Number of times repeated | | | Residual | | |
| | Alloy No. | Process No. | Matrix (Parent phase) | Precipitation phase | grain boundaries (N = 20) | Maximum (times) | Minimum (times) | Evaluation | strain (%) | Evaluation | Comprehensive evaluation |
| Comparative Example 1 | 1 | A | $L2_1$ | = | 1.75 | 5000 | 211 | 3 | 2.9 | 3 | D |
| Comparative Example 2 | 1 | B | $L2_1$ | = | 2.00 | 2350 | 52 | 3 | 3.0 | 3 | D |
| Comparative Example 3 | 1 | C | $L2_1$ | = | 1.80 | 5000 | 98 | 3 | 2.8 | 3 | D |
| Comparative Example 4 | 1 | D | $L2_1$ | = | 2.20 | 5000 | 38 | 3 | 3.2 | 3 | D |
| Comparative Example 5 | 1 | E | $L2_1$ | = | 2.20 | 3895 | 86 | 3 | 3.0 | 3 | D |
| Comparative Example 6 | 1 | F | $L2_1$ | = | 1.80 | 1983 | 50 | 3 | 3.0 | 3 | D |
| Comparative Example 7 | 1 | G | $L2_1$ | = | 1.80 | 1884 | 87 | 3 | 3.0 | 3 | D |
| Comparative Example 8 | 1 | H | $L2_1$ | = | 2.20 | 4559 | 45 | 3 | 2.9 | 3 | D |
| Comparative Example 9 | 1 | I | $L2_1$ | = | 2.50 | 789 | 118 | 3 | Not reached | 3 | D |
| Comparative Example 10 | 1 | J | $L2_1$ | = | 2.50 | 422 | 225 | 3 | Not reached | 3 | D |
| Comparative Example 11 | 1 | K | $L2_1$ | = | 2.50 | 688 | 321 | 3 | Not reached | 3 | D |
| Comparative Example 12 | 1 | L | $L2_1$ | = | 2.25 | 427 | 200 | 3 | Not reached | 3 | D |
| Comparative Example 13 | 1 | M | $L2_1$ | = | 0.00 | 5000 | / | 1 | 2.2 | 3 | D |
| Comparative Example 14 | 1 | N | $L2_1$ | = | 0.00 | 5000 | / | 1 | 2.1 | 3 | D |
| Comparative Example 15 | 1 | O | $L2_1$ | = | 0.10 | 5000 | / | 1 | 2.7 | 3 | D |
| Comparative Example 16 | 1 | P | $L2_1$ | = | 0.05 | 5000 | / | 1 | 2.3 | 3 | D |
| Comparative Example 17 | 1 | Q | $L2_1$ | = | 0.05 | 5000 | 3005 | 2 | 2.3 | 3 | D |
| Comparative Example 18 | 1 | R | $L2_1$ | = | 0.00 | 5000 | / | 1 | 2.4 | 3 | D |
| Comparative Example 19 | 1 | S | $L2_1$ | = | 0.05 | 5000 | / | 1 | 2.2 | 3 | D |
| Comparative Example 20 | 1 | T | $L2_1$ | = | 0.05 | 5000 | 4667 | 2 | 2.2 | 3 | D |
| Comparative Example 21 | 1 | U | $L2_1$ | = | 0.00 | 5000 | / | 1 | 2.3 | 3 | D |
| Comparative Example 22 | 1 | V | $L2_1$ | = | 0.00 | 5000 | / | 1 | 2.5 | 3 | D |
| Comparative Example 20(1) | 1 | W | $L2_1$ | = | 0.05 | 5000 | 4667 | 2 | 2.2 | 3 | D |
| Comparative Example 21(1) | 1 | X | $L2_1$ | = | 0.00 | 5000 | / | 1 | 2.3 | 3 | D |
| Comparative Example 22(1) | 1 | Y | $L2_1$ | = | 0.00 | 5000 | / | 1 | 2.5 | 3 | D |

(Note)
Symbol "—" in the table indicates that the corresponding step was not performed and symbol "=" indicates that no precipitation phase was confirmed. Furthermore, symbol "/" indicates that all specimens were not fractured until 5000 times, and moreover, "Not reached" in the table indicates that the corresponding specimen was fractured when the number of times repeated was less than 1000.

TABLE 4-2

| | | | Structure | | | Characteristic evaluation | | | | | |
|---|---|---|---|---|---|---|---|---|---|---|---|
| | | | | | Existence frequency P | Fracture resistance | | | | | |
| | | | Crystal structure | | of crystal | Number of times repeated | | | Fatigue resistance | | |
| | Alloy No. | Process No. | Matrix (Parent phase) | Precipitation phase | grain boundaries (N = 20) | Maximum (times) | Minimum (times) | Evaluation | Residual strain (%) | Evaluation | Comprehensive evaluation |
| Comparative Example 23 | 28 | a | $L2_1$ | = | 0.05 | 5000 | / | 1 | 3.2 | 3 | D |
| Comparative Example 24 | 29 | a | $L2_1$ | = | 0.00 | 5000 | / | 1 | 2.2 | 3 | D |
| Comparative Example 25 | 30 | a | $L2_1$ | = | 0.05 | 5000 | / | 1 | 2.3 | 3 | D |
| Comparative Example 26 | 31 | a | $L2_1$ | = | 0.10 | 5000 | 4950 | 1 | 2.7 | 3 | D |
| Comparative Example 27 | 32 | a | $L2_1$ | = | 0.10 | 5000 | / | 1 | 2.1 | 3 | D |
| Comparative Example 23 | 33 | a | $L2_1$ | = | 0.10 | 5000 | 3354 | 1 | 2.5 | 3 | D |
| Comparative Example 29 | 34 | a | $L2_1$ | = | 0.10 | 5000 | 3739 | 1 | 3.0 | 3 | D |
| Comparative Example 30 | 35 | a | $L2_1$ | = | 0.03 | 5000 | / | 1 | 2.2 | 3 | D |
| Comparative Example 31 | 36 | a | $L2_1$ | = | 0.05 | 5000 | / | 1 | 2.4 | 3 | D |
| Comparative Example 32 | 37 | a | $L2_1$ | = | 0.03 | 5000 | / | 1 | 2.3 | 3 | D |
| Comparative Example 33 | 38 | a | $L2_1$ | = | 0.10 | 5000 | 3871 | 2 | 2.5 | 3 | D |
| Comparative Example 34 | 39 | a | $L2_1$ | = | 0.10 | 5000 | 3659 | 2 | 2.6 | 3 | D |
| Comparative Example 35 | 40 | a | $L2_1$ | = | 0.10 | 5000 | 4021 | 2 | 2.6 | 3 | D |
| Comparative Example 36 | 41 | a | $L2_1$ | = | 0.10 | 5000 | 4874 | 2 | 2.3 | 3 | D |
| Comparative Example 37 | 42 | a | $L2_1$ | = | 0..05 | 5000 | / | 1 | 2.2 | 3 | D |
| Comparative Example 33 | 43 | a | $L2_1$ | = | 0.10 | 5000 | 2743 | 2 | 2.6 | 3 | D |
| Comparative Example 39 | 44 | a | $L2_1$ | A1 | >3.00 | 2 | 3 | 3 | Not reached | 3 | D |
| Comparative Example 43 | 45 | d | $L2_1$ | = | 0.20 | 1008 | 64 | 3 | 3.8 | 3 | D |
| Comparative Example 41 | 46 | a | $L2_1$ | A1 | >3.00 | 4 | 0 | 3 | Not reached | 3 | D |
| Comparative Example 42 | 47 | a | | | | Could not be produced | | | | | D |
| Comparative Example 43 | 48 | g | $L2_1$ | = | 0.00 | 5000 | / | 1 | 2.1 | 3 | D |
| Comparative Example 44 | 49 | a | | | | Could not be produced | | | | | D |
| Comparative Example 45 | 2 | M | A2 | = | 0.00 | 0 | 0 | 3 | Not reached | 3 | D |
| Comparative Example 46 | 5 | M | B2 | = | 0.00 | 2 | 0 | 3 | Not reached | 3 | D |
| Comparative Example 47 | 7 | M | $L2_1$ | = | 0.00 | 5000 | / | 1 | 2.4 | 3 | D |

(Note)

Symbol "—" in the table indicates that the corresponding step was not performed and symbol "=" indicates that no precipitation phase was confirmed. Furthermore, symbol "/" indicates that all specimens were not fractured until 5000 times, and moreover, "Not reached" in the table indicates that the corresponding specimen was fractured when the number of times repeated was less than 1000.

Figure 6:
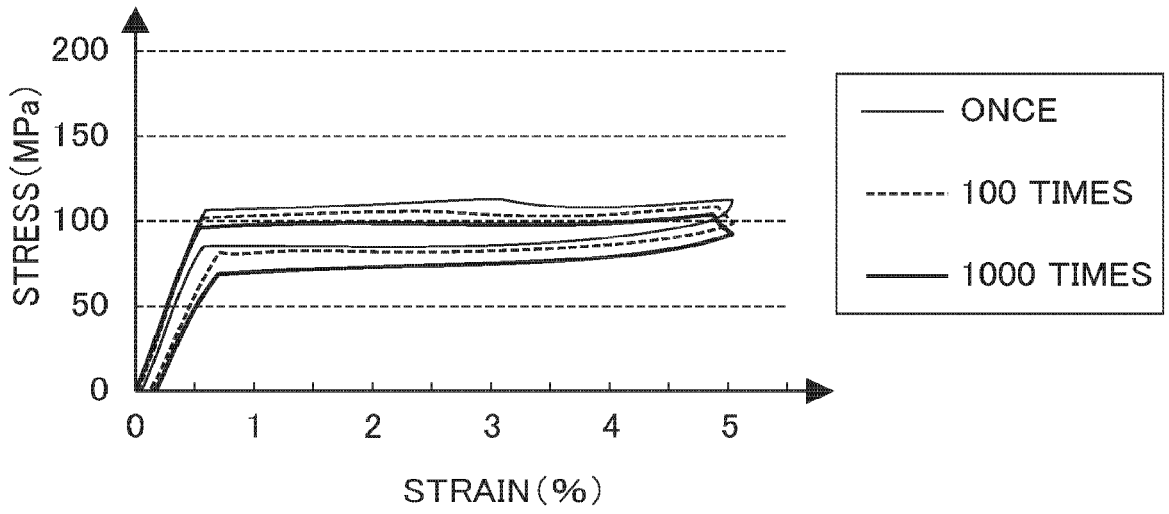
FIG. 6 is stress-strain curves (S-S curves) when deformation caused by loading and unloading of a stress corresponding to a 5% strain was applied to the copper-based alloy material of Example 1, and shows a case where the cycle of loading and unloading of the stress was performed once (number of repeated cycles: 1), a case where the cycle was repeated 100 times (number of repeated cycles: 100) and a case where the cycle was repeated 1000 times (number of repeated cycles: 1000)
Figure 7:
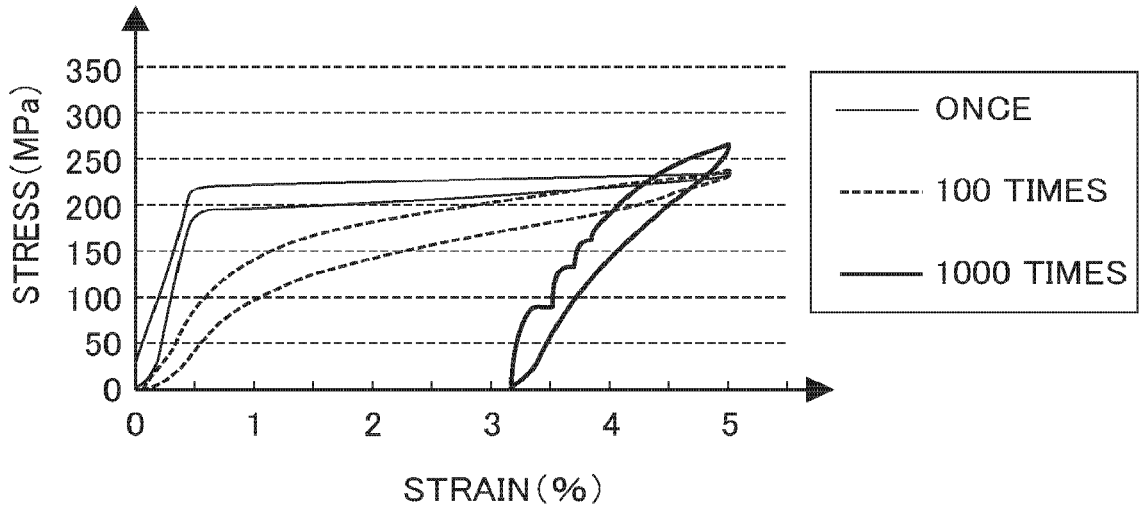
FIG. 7 is stress-strain curves (S-S curves) when deformation caused by loading and unloading of a stress corresponding to a 5% strain was applied to the copper-based alloy material of Comparative Example 23, and shows a case where the cycle of loading and unloading of the stress was performed once (number of repeated cycles: 1), a case where the cycle was repeated 100 times (number of repeated cycles: 100) and a case where the cycle was repeated 1000 times (number of repeated cycles: 1000).

It is found from the evaluation results of tables 3 and 4 that since in each of Examples 1 to 60, a multiphase (two-phase) structure was provided in which the precipitation phase of the B2-type crystal structure was dispersed in the matrix of the β phase having an $L2_1$-type, B2-type or A2-type crystal structure, the fatigue resistance when the repeated deformation was performed was the acceptance level of "1" or "2", and the comprehensive evaluation of the repeated deformation resistance was also the acceptance level of "C" or more. On the other hand, since in Comparative Examples 1 to 22 and 45 to 47, the production conditions specified in the present invention were not satisfied, and in Comparative Examples 23 to 44, the proper range of the alloy composition specified in the present invention was not satisfied, thus in each of the Comparative Examples, the evaluation of the fatigue resistance was so poor as to be "3" and the comprehensive evaluation of the repeated deformation resistance was the rejection level of "D. It is found that although in Comparative Examples 39 and 41, a multiphase (two-phase) structure was provided in which a precipitation phase was dispersed in the matrix of the β phase having the $L2_1$-type crystal structure, since the precipitation phase was the α phase (fcc structure=A1), the multiphase (two-phase) structure was different from the two-phase structure of the copper-based alloy material of the present invention, and both the fatigue resistance and the fracture resistance were inferior. FIGS. 6 and 7 respectively show stress-strain curves (S-S curves) after loading and unloading of a stress applying a 5% strain to the copper-based alloy materials of Example 1 and Comparative Example 23 was repeated only once, 100 times and 1000 times. It is found from the comparison of FIGS. 6 and 7 that in the copper-based alloy material of Example 1, no significant change was produced in the S-S curves in which the loading and unloading was repeated only once, 100 times and 1000 times and the residual strain after the loading and unloading was repeated 1000 times was so small as to be 0.2% whereas in the copper-based alloy material of Comparative Example 23, significant changes were produced in the S-S curves in which the loading and unloading was repeated only once, 100 times and 1000 times and the residual strain after the loading and unloading was repeated 1000 times in particular was so large as to be 3.2%. Furthermore, in the case of the copper-based alloy materials of the present invention except those described in table 1 and in the case of a plate material (strip material) instead of the bar material (wire material), though the results of tests thereof are omitted, similar results to those of Examples described above were obtained.

EXPLANATION OF REFERENCE NUMERALS

1 (bar-shaped or wire-shaped) copper-based alloy material

2, 3 end surfaces of copper-based alloy material 1

4 entire circumferential surface of copper-based alloy material 1
4*a*, 4*b* semi-circumferential surfaces
5, 6 end edges of copper-based alloy material 1
5*a*, 6*a* end edge half portions
5*a*1, 5*a*2 both ends of end edge half portion 5*a*
6*a*1, 6*a*2 both ends of end edge half portion 6*a*
7, 8 extension line portions
9 semi-circumferential surface (hatched region)
10 (plate-shaped) copper-based alloy material
12, 13 end edges of copper-based alloy material 10
14*a*, 14*b* surfaces forming semi-circumferential surface 19
15, 16 end edges of copper-based alloy material 10
15*a* to 15*d* sides forming end edge 15
16*a* to 16*d* sides forming end edge 16
15*ab*, 16*ab* end edge half portions
15*ab*1, 15*ab*2 both ends of end edge half portion 15*ab*
16*ab*1, 16*ab*2 both ends of end edge half portion 16*ab*
17, 18 extension line portions
19 semi-circumferential surface (hatched region)
X crystal grain boundary
P existence frequency of crystal grain boundaries
n existence number of crystal grain boundaries
D diameter of copper-based alloy material 1
RD direction of working of copper-based alloy materials 1, 10
ND normal direction (or thickness direction) of copper-based alloy material 10
TD direction of plate width of copper-based alloy material 10
W plate width of copper-based alloy material 10
T plate thickness of copper-based alloy material 10

The invention claimed is:

1. A copper-based alloy material comprising a multiphase structure comprising a matrix of a β phase and a precipitation phase of a B2 crystal structure dispersed in the matrix, wherein the copper-based alloy material comprises a composition comprising 8.6 to 12.6% by mass of Al, 2.9 to 8.9% by mass of Mn, 3.2 to 10.0% by mass of Ni, and Cu, and the matrix includes a $L2_1$ crystal structure, wherein a residual strain of the alloy material after loading and unloading of a stress applying a 5% strain to the alloy material is repeated 1000 times is equal to or less than 2.0%.

2. The copper-based alloy material according to claim 1, which has a shape-memory alloy characteristic.

3. The copper-based alloy material according to claim 1, wherein in the alloy material, a direction of working which is a direction of rolling or a direction of wire drawing is a direction of extension, a cross section is circular or polygonal and an elongated shape is provided as a whole, and when a semi-circumferential surface obtained by partitioning an entire circumferential surface which is a surface other than both end surfaces of the alloy material with a pair of end edge half portions which are respectively located in end edges of both the end surfaces and which have a semi-circumferential length corresponding to a length of half an entire circumference of the end edges and a pair of extension line portions which respectively couples both ends of the pair of end edge half portions and which are generatrices or ridge lines of the alloy material is seen, a crystal grain boundary does not exist on the semi-circumferential surface or an existence frequency of the crystal grain boundary is equal to or less than 0.2 even when the crystal grain boundary exists.

4. A copper-based alloy material comprising a multiphase structure comprising a matrix of a β phase and a precipitation phase of a B2 crystal structure dispersed in the matrix, wherein the copper-based alloy material comprises a composition comprising 8.6 to 12.6% by mass of Al, 2.9 to 8.9% by mass of Mn, 3.2 to 10.0% by mass of Ni, and Cu, and the matrix includes a $L2_1$ crystal structure, wherein when loading and unloading of a stress applying a 3% strain to the alloy material is repeated, a number of times the loading and unloading is repeated until the alloy material is fractured is equal to or greater than 1000.

5. The copper-based alloy material according to claim 1, wherein the composition further comprises a total of 0.001 to 10.000% by mass of at least one component selected from the group consisting of 0.001 to 2.000% by mass of Co, 0.001 to 3.000% by mass of Fe, 0.001 to 2.000% by mass of Ti, 0.001 to 1.000% by mass of V, 0.001 to 1.000% by mass of Nb, 0.001 to 1.000% by mass of Ta, 0.001 to 1.000% by mass of Zr, 0.001 to 2.000% by mass of Cr, 0.001 to 1.000% by mass of Mo, 0.001 to 1.000% by mass of W, 0.001 to 2.000% by mass of Si, 0.001 to 0.500% by mass of C, and 0.001 to 5.000% by mass of misch metal.

6. A method for producing a copper-based alloy material according to claim 1, the copper-based alloy material comprising a composition comprising 8.6 to 12.6% by mass of Al, 2.9 to 8.9% by mass of Mn, 3.2 to 10.0% by mass of Ni, and Cu, the method comprising:

(i) melting and casting raw materials of the copper-based alloy material;

(ii) performing hot working;

(v) performing each of a step (iii) performing intermediate annealing in a first temperature range of 400 to 680° C. and a step (iv) performing cold working in which a working rate is equal to or greater than 30% at least one or more times in this order and thereafter further performing additional intermediate annealing in a second temperature range of 400 to 550° C.;

(vi) performing heating from room temperature to a third temperature range of 400 to 650° C. and holding the third temperature range;

(vii) further performing heating from the third temperature range to a fourth temperature range of 700 to 950° C. and holding the fourth temperature range; and (x) repeating a step (viii) performing cooling from the fourth temperature range to the third temperature range and holding the third temperature range and a step (ix) performing heating from the third temperature range to the fourth temperature range and holding the fourth temperature range at least two or more times and thereafter performing quenching from the fourth temperature range.

7. The method for producing a copper-based alloy material according to claim 6, the method further comprising:

(xi) performing, after performing quenching in (x), heating to a fifth temperature range of 80 to 300° C. and holding the fifth temperature range.

8. A spring material comprising the copper-based alloy material according to claim 1.

9. A damper comprising the copper-based alloy material according to claim 1.

10. A brace comprising the copper-based alloy material according to claim 1.

11. A screw or bolt comprising the copper-based alloy material according to claim 1.

12. An energized actuator comprising the copper-based alloy material according to claim 1.

13. A magnetic actuator comprising the copper-based alloy material according to claim 1.

14. A magnetic sensor comprising the copper-based alloy material according to claim 1.

15. A Cu—Al—Mn—Ni based alloy material comprising a multiphase structure comprising a matrix of a β phase and a precipitation phase of a B2 crystal structure dispersed in the matrix, wherein the Cu—Al—Mn—Ni based alloy material comprises a composition comprising 8.6 to 12.6% by mass of Al, 2.9 to 8.9% by mass of Mn, 3.2 to 10.0% by mass of Ni, and Cu, and the precipitation phase of the B2 crystal structure is a precipitation phase of NiAl, which does not precipitate in a Cu—Al—Mn ternary alloy, wherein a residual strain of the alloy material after loading and unloading of a stress applying a 5% strain to the alloy material is repeated 1000 times is equal to or less than 2.0%.

16. The copper-based alloy material according to claim 4, which has a shape-memory alloy characteristic.

17. The copper-based alloy material according to claim 4, wherein in the alloy material, a direction of working which is a direction of rolling or a direction of wire drawing is a direction of extension, a cross section is circular or polygonal and an elongated shape is provided as a whole, and when a semi-circumferential surface obtained by partitioning an entire circumferential surface which is a surface other than both end surfaces of the alloy material with a pair of end edge half portions which are respectively located in end edges of both the end surfaces and which have a semi-circumferential length corresponding to a length of half an entire circumference of the end edges and a pair of extension line portions which respectively couples both ends of the pair of end edge half portions and which are generatrices or ridge lines of the alloy material is seen, a crystal grain boundary does not exist on the semi-circumferential surface or an existence frequency of the crystal grain boundary is equal to or less than 0.2 even when the crystal grain boundary exists.

18. The copper-based alloy material according to claim 4, wherein the composition further comprises a total of 0.001 to 10.000% by mass of at least one component selected from the group consisting of 0.001 to 2.000% by mass of Co, 0.001 to 3.000% by mass of Fe, 0.001 to 2.000% by mass of Ti, 0.001 to 1.000% by mass of V, 0.001 to 1.000% by mass of Nb, 0.001 to 1.000% by mass of Ta, 0.001 to 1.000% by mass of Zr, 0.001 to 2.000% by mass of Cr, 0.001 to 1.000% by mass of Mo, 0.001 to 1.000% by mass of W, 0.001 to 2.000% by mass of Si, 0.001 to 0.500% by mass of C, and 0.001 to 5.000% by mass of misch metal.

19. A method for producing a copper-based alloy material according to claim 4, the copper-based alloy material comprising a composition comprising 8.6 to 12.6% by mass of Al, 2.9 to 8.9% by mass of Mn, 3.2 to 10.0% by mass of Ni, and Cu, the method comprising:

(i) melting and casting raw materials of the copper-based alloy material;

(ii) performing hot working;

(v) performing each of a step (iii) performing intermediate annealing in a first temperature range of 400 to 680° C. and a step (iv) performing cold working in which a working rate is equal to or greater than 30% at least one or more times in this order and thereafter further performing additional intermediate annealing in a second temperature range of 400 to 550° C.;

(vi) performing heating from room temperature to a third temperature range of 400 to 650° C. and holding the third temperature range;

(vii) further performing heating from the third temperature range to a fourth temperature range of 700 to 950° C. and holding the fourth temperature range; and (x) repeating a step (viii) performing cooling from the fourth temperature range to the third temperature range and holding the third temperature range and a step (ix) performing heating from the third temperature range to the fourth temperature range and holding the fourth temperature range at least two or more times and thereafter performing quenching from the fourth temperature range.

20. The method for producing a copper-based alloy material according to claim 19, the method further comprising:

(xi) performing, after performing quenching in (x), heating to a fifth temperature range of 80 to 300° C. and holding the fifth temperature range.

21. A spring material comprising the copper-based alloy material according to claim 4.

22. A damper comprising the copper-based alloy material according to claim 4.

23. A brace comprising the copper-based alloy material according to claim 4.

24. A screw or bolt comprising the copper-based alloy material according to claim 4.

25. An energized actuator comprising the copper-based alloy material according to claim 4.

26. A magnetic actuator comprising the copper-based alloy material according to claim 4.

27. A magnetic sensor comprising the copper-based alloy material according to claim 4.

28. A Cu—Al—Mn—Ni based alloy material comprising a multiphase structure comprising a matrix of a β phase and a precipitation phase of a B2 crystal structure dispersed in the matrix, wherein the Cu—Al—Mn—Ni based alloy material comprises a composition comprising 8.6 to 12.6% by mass of Al, 2.9 to 8.9% by mass of Mn, 3.2 to 10.0% by mass of Ni, and Cu, and the precipitation phase of the B2 crystal structure is a precipitation phase of NiAl, which does not precipitate in a Cu—Al—Mn ternary alloy, wherein when loading and unloading of a stress applying a 3% strain to the alloy material is repeated, a number of times the loading and unloading is repeated until the alloy material is fractured is equal to or greater than 1000.

* * * * *